US008458863B2

(12) United States Patent
Hunts

(10) Patent No.: US 8,458,863 B2
(45) Date of Patent: Jun. 11, 2013

(54) MAGNETIC CONNECTOR APPARATUS AND RELATED SYSTEMS AND METHODS

(75) Inventor: Larry Dean Hunts, Dongguan (CN)

(73) Assignee: Sparkling Sky International Limited, Hong Kong (HK)

( * ) Notice: Subject to any disclaimer, the term of this patent is extended or adjusted under 35 U.S.C. 154(b) by 0 days.

(21) Appl. No.: 13/561,724

(22) Filed: Jul. 30, 2012

(65) Prior Publication Data

US 2013/0113584 A1 May 9, 2013

Related U.S. Application Data

(63) Continuation-in-part of application No. 13/297,953, filed on Nov. 16, 2011.

(60) Provisional application No. 61/555,392, filed on Nov. 3, 2011.

(51) Int. Cl.
*A63H 33/04* (2006.01)

(52) U.S. Cl.
USPC ..... 24/303; 446/92

(58) Field of Classification Search
None
See application file for complete search history.

(56) References Cited

U.S. PATENT DOCUMENTS

| | | | | |
|---|---|---|---|---|
| 2,500,180 | A * | 3/1950 | Hubbell | 213/75 TC |
| 2,795,893 | A | 6/1957 | Vayo | |
| 2,872,754 | A | 2/1959 | Cronberger | |
| 2,939,243 | A | 6/1960 | Duggar | |
| 3,184,882 | A | 5/1965 | Vega | |
| 3,254,440 | A | 6/1966 | Duggar | |
| 3,303,606 | A | 2/1967 | Mann | |
| 3,998,004 | A | 12/1976 | Ehrlich | |
| 4,238,905 | A | 12/1980 | MacGraw, II | |
| 4,334,871 | A | 6/1982 | Roane | |
| 4,401,960 | A | 8/1983 | Uchikune et al. | |
| 4,462,596 | A | 7/1984 | Yamamoto | |
| 5,009,625 | A | 4/1991 | Longuet-Higgins | |
| 5,048,704 | A | 9/1991 | Takahashi | |
| 5,347,253 | A | 9/1994 | Ogikubo | |
| 5,409,236 | A | 4/1995 | Therrien | |
| 5,411,262 | A | 5/1995 | Smith | |
| 5,746,638 | A | 5/1998 | Shiraishi | |
| 5,892,174 | A * | 4/1999 | Hirawata | 174/50 |
| 6,024,626 | A | 2/2000 | Mendelsohn | |
| 6,241,249 | B1 | 6/2001 | Wang | |

(Continued)

FOREIGN PATENT DOCUMENTS

| | | |
|---|---|---|
| EP | 51576 A2 | 5/1982 |
| JP | 3822062 | 6/2006 |

*Primary Examiner* — Jack W. Lavinder
(74) *Attorney, Agent, or Firm* — Phillips Ryther & Winchester; Matthew D. Thayne

(57) ABSTRACT

A magnetic connector apparatus may comprise one or more magnet housings, each of which may comprise one or more magnets positioned therein to rotate within the magnet housing(s). The apparatus may be configured using one or more safety features in order to prevent access and/or removal of the magnet(s). In some embodiments, the apparatus may further comprise an inner retainer piece coupled with the one or more magnet housings, a first outer housing piece coupled with the inner retainer piece, and a second outer housing piece coupled with the inner retainer piece. The first outer housing piece may be positioned on an opposite side of the connector apparatus from the second outer housing piece such that the inner retainer piece is positioned in between the first outer housing piece and the second outer housing piece. Novel methods for manufacturing a magnetic connector apparatus are also disclosed.

29 Claims, 35 Drawing Sheets

U.S. PATENT DOCUMENTS 6,749,480 B1 6/2004 Hunts
6,969,294 B2 11/2005 Vicentelli
7,154,363 B2 12/2006 Hunts
7,413,493 B2 * 8/2008 Toht et al. ..... 446/92

* cited by examiner

MAGNETIC CONNECTOR APPARATUS AND RELATED SYSTEMS AND METHODS

RELATED APPLICATIONS

This application is a continuation-in-part of U.S. patent application Ser. No. 13/297,953 titled "MULTI-POLE MAGNETIC CONNECTOR APPARATUS" and filed on Nov. 16, 2011, which claims the benefit under 35 U.S.C. §119(e) of U.S. Provisional Patent Application No. 61/555,392 filed on Nov. 3, 2011 and is also titled "MULTI-POLE MAGNETIC CONNECTOR APPARATUS." Both of the foregoing applications are hereby incorporated by reference in their entireties.

TECHNICAL FIELD

This disclosure relates to magnetic connectors. More particularly, this disclosure relates to magnetic connectors configured to rotate in order to magnetically link two objects, and related systems and methods, including housings and magnetic assemblies for such magnetic connectors.

BRIEF DESCRIPTION OF THE DRAWINGS

Non-limiting and non-exhaustive embodiments of the disclosure are described, including various embodiments of the disclosure with reference to the figures, in which.

Figure 1A:
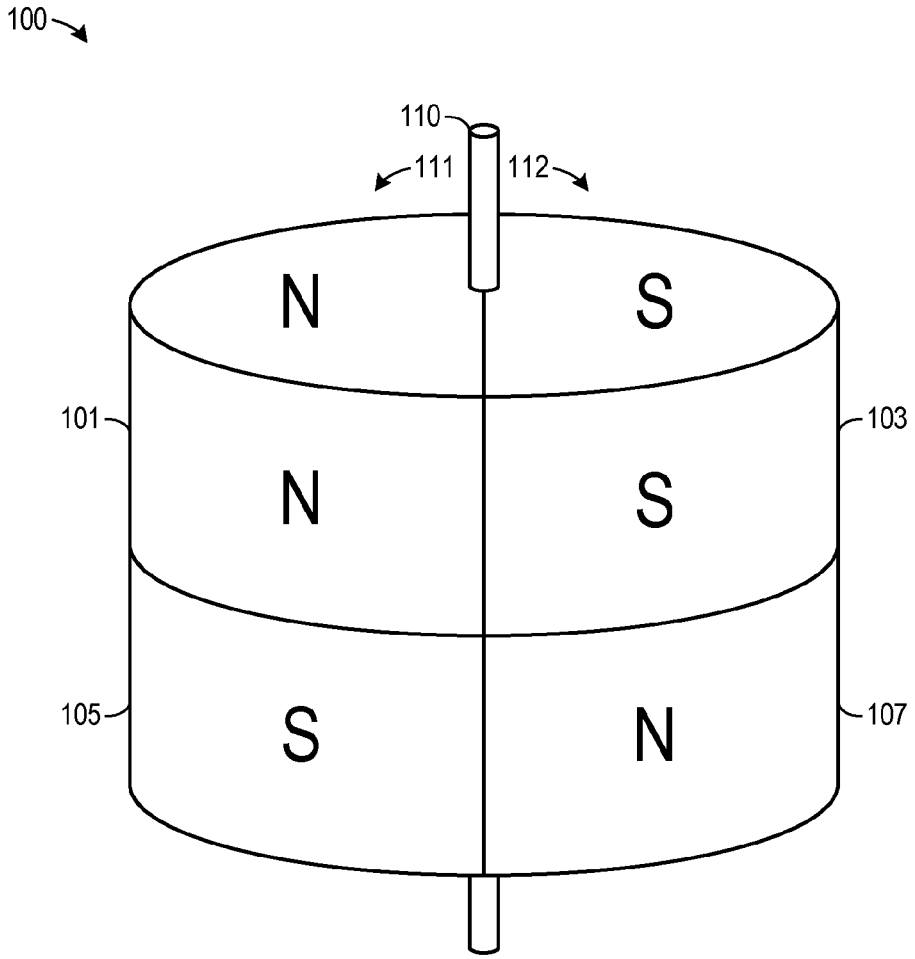
FIG. 1A illustrates a multi-pole magnetic assembly configured with four magnetic sections of alternating polarities.

In the following description, numerous specific details are provided for a thorough understanding of the various embodiments disclosed herein. The systems and methods disclosed herein can be practiced without one or more of the specific details, or with other methods, components, materials, etc. In addition, in some cases, well-known structures, materials, or operations may not be shown or described in detail in order to avoid obscuring aspects of the disclosure. Furthermore, the described features, structures, or characteristics may be combined in any suitable manner in one or more alternative embodiments.

DETAILED DESCRIPTION

Described herein are embodiments of magnetic connector apparatus that may comprise magnetic connectors configured to rotate in order to magnetically link two objects. Such magnetic connectors as described herein may comprise one or more magnet housings. One or more magnets may be positioned within one or more of the magnet housings such that the magnet(s) can rotate within the magnet housing(s). In preferred embodiments, the magnet(s) may comprise a neodymium magnet(s) or another high-strength/flux magnet.

In some embodiments, the magnet housing(s) may be configured to inhibit removal of the magnets for safety purposes. Because of the high strength of neodymium magnets and other similar magnets, it may be desirable to restrict access to such magnets to users of a magnetic connector apparatus, particularly children. The dangers associated with ingesting such magnets have been well documented. Ingesting high-strength magnets can, in some cases, even lead to death. It may therefore be desirable to construct the magnet housing(s) in such a manner that access to the magnets contained within such housings is restricted. This may be done in a variety of ways, as described in greater detail.

For example, the material(s) used to form the magnet housing(s) may be very rigid, durable, strong, and/or tough to prevent a user (such as a child) from breaking the housing to allow the magnet(s) contained therein to be removed or accessed. As another example, sonic welding may be used such that various components of the apparatus are sealed together in such a manner that these components are difficult, if not impossible, to separate by breaking the sonic weld. As still another example, one or more components may be provided in order to at least substantially plug one or more openings in the magnet housings to further restrict access to the magnet within. As yet another example, part of the magnetic connector apparatus may comprise one or more recessed regions that may be configured to receive one or more portions of the magnet housing to make it more difficult to remove the magnet housing from the magnetic connector apparatus.

As still another example of a safety feature for restricting access to the magnet(s), the magnetic connector apparatus may include one or more fasteners for coupling the magnet housing to another portion of the apparatus. In some preferred embodiments, the fasteners may comprise rivets or other such fasteners that cannot easily be removed by a user in order to further enhance the safety features of the apparatus.

The magnet housing may also comprise one or more reinforced regions wherein the material is thicker at locations that might otherwise be vulnerable to wear, tampering, and the like. Similarly, areas of the magnet housing adjacent to any opening for receiving a fastener may be reinforced, appropriately bent, shaped, or otherwise configured to further ensure that the magnet contained therein cannot be removed and/or that the magnet housing cannot be removed from the magnetic connector apparatus. In preferred embodiments, multiple, redundant safety features/components are incorporated into the apparatus to provide further protection against unwanted access to the magnet(s). By providing redundant safety features/components, such as a high-strength steel magnet housing and sonic welding, the chances that a magnet may be removed from the apparatus may be dramatically decreased, if not eliminated altogether.

The magnet housing(s) may each be positioned along a connection edge of the magnetic connector apparatus, such that the connection edge is configured to be magnetically connected with a connection edge of another magnetic connector apparatus. In this manner, magnetic connector apparatus of various different shapes and sizes may be coupled together to build larger structures, toys, play games, etc.

As described in greater detail below, in some embodiments, each magnet may comprise a multi-pole magnet assembly. Such an assembly may comprise a first half and a second half extending substantially along a longitudinal axis. The first half may comprise at least two magnetic sections of alternating polarity and the second half may comprise a corresponding number of magnetic sections. Each magnetic section in the second half may have a polarity opposite that of an adjacent magnetic section in the first half such that the polarity of the magnet alternates along its length. As described below, these assemblies may provide several advantages that may be useful for certain implementations of the inventions described herein.

However, various components and elements disclosed herein, including but not limited to the magnet housing and, retainer pieces, and housing pieces disclosed herein, may be used with other types of magnets. For example, in some embodiments, the magnets need not be configured such that they alternate in polarity along their respective lengths. Instead, magnets with just two poles may be used, such as those disclosed in U.S. Pat. No. 7,154,363 titled "Magnetic Connector Apparatus," for example.

In some embodiments, the magnetic connector apparatus may comprise a housing comprising an inner retainer piece coupled with the magnet housing, a first outer housing piece coupled with the inner retainer piece, and a second outer housing piece coupled with the inner retainer piece. The first outer housing piece may be positioned on an opposite side of the connector apparatus from the second outer housing piece such that the inner retainer piece is positioned in between the first outer housing piece and the second outer housing piece.

In some embodiments, the magnetic connector apparatus may further comprise a magnet housing receiver configured to engage the magnet housing to couple the magnet housing to the inner retainer piece. The magnet housing receiver may comprise one or more magnet housing engaging members. In embodiments comprising two magnet housing engaging members, a first magnet housing engaging member may be configured to engage a first end of the magnet housing, and a second magnet housing engaging member may be configured to engage a second end of the magnet housing opposite from the first end.

In some embodiments, the first magnet housing engaging member may comprise one or more magnet housing plugs. In embodiments comprising two magnet housing plugs, a first magnet housing plug may be configured to at least substantially seal an opening in the magnet housing at the first end, and a second magnet housing plug may be configured to at least substantially seal an opening in the magnet housing at the second end.

The magnet housing may, in some embodiments, comprise a body member comprising a cylindrical cavity. The magnet may be positioned within the cylindrical cavity. The magnet may be rotatable within the cavity or, alternatively, and as explained in greater detail below, the magnet may be rotatable within another enclosure positioned within the cavity. As still another alternative, the magnet may be positioned within another enclosure and the enclosure/magnet combination may be rotatable with respect to the magnet housing.

One or more plate members may extend from the body member of the magnet housing. The plate member(s) may be coupled to an outer surface of the inner retainer piece. The magnetic connector apparatus may further comprise one or more fasteners for coupling the plate member(s) to the inner retainer piece. The fastener(s) may be positioned through fastener openings within the plate member(s) and/or inner retainer piece. The fastener(s) may comprise a rivet, screw, bolt, pin, or the like.

In embodiments comprising magnet housings having two plate members, a first plate member may extend from the body member and be coupled to a first surface of the inner retainer piece. A second plate member may extend from the body member and be coupled to a second surface of the inner retainer piece opposite from the first surface.

The inner retainer piece may comprise one or more recessed regions on the inner retainer piece for seating/receiving the one or more plate members. For example, a first recessed region may be formed within or otherwise positioned on the first surface for receiving the first plate member, and a second recessed region may be formed within or otherwise positioned on the second surface for receiving the second plate member.

The magnetic connector may further comprise an enclosure to encase the magnet. The enclosure may be positioned within the magnet housing. The enclosure may be configured such that it is rotatable with respect to the magnet housing. Alternatively, the enclosure may be fixed with respect to the magnet housing such that the magnet is rotatable with respect to the enclosure (and the housing).

The magnetic connector apparatus may comprise a plurality of magnets/magnet housings, each of which may be positioned along a connection edge of the apparatus such that multiple edges of the apparatus may be used to magnetically couple the apparatus with another magnetic connector apparatus. Each magnet positioned within each of the magnet housings may be configured such that the magnet can rotate within its respective magnet housing such that opposing polarities of the magnets can be aligned and lock two or more magnet connector apparatus together.

In some embodiments, two or more multi-pole magnetic assemblies may be configured to rotate with respect to one another in order to align opposite polarities and magnetically link two or more components. According to various embodiments, a multi-pole magnetic assembly may be cylindrical, rectangular, prismic, and/or oblong. Alternative shapes are contemplated as well. A multi-pole magnetic assembly may include any number of magnetic sections, each adjacent magnetic section having an alternating polarity. Magnetic assemblies may be encased within an enclosure, such as a cylindrical or triangular prismic enclosure. Alternatively, magnetic assemblies may be otherwise affixed to a connection member or another component of the connector apparatus. For example, a rod may be positioned to extend through a central axis of one or more magnetic assemblies to facilitate the rotation.

In some embodiments, the multi-pole magnetic assembly may be configured to rotate within and with respect to the enclosure. In alternative embodiments, the enclosure encasing the multi-pole magnetic assembly is configured to rotate. Enclosures and/or magnetic assemblies forming part of a universal connector apparatus may be configured to rotate with respect to one another in order to align opposite polarities. In some embodiments, the magnetic assemblies rotate with respect to the enclosures. In other embodiments, the magnetic assemblies are fixed within their respective enclosures and the enclosures rotate with respect to one another in order to align the polarities of the encased magnetic assemblies.

In some embodiments, connection members may be secured end to end in order to form a triangle, square, rectangle, another polygon, or another shape. Alternatively, connection members may be joined together at the ends in order to form a polygonal framework having any number of sides, or connection edges. A rotatable multi-pole magnetic assembly may be positioned and rotatably secured adjacent one or more edges of the polygon. For example, a cylindrical magnet may be positioned adjacent each side of a polygon. With regard to still other embodiments, solid objects, such as triangles and squares, may include rotatable multi-pole magnetic assemblies positioned adjacent one or more edges of the polygonal solid object.

An enclosure may be fixedly secured adjacent one or more side edges of a polygonal shape. Accordingly, in order to align polarities, a magnetic assembly within each secured enclosure may be configured to freely rotate in order to align polarities.

In other embodiments, two-dimensional objects, such as squares, rectangles, and triangles, may be magnetically linked in order to create three-dimensional objects, such as pyramids and tetrahedrons.

In some embodiments of methods for forming the multi-pole magnets, a magnetizing apparatus may be adapted to form a multi-pole magnetic assembly, including multiple magnetic sections. A bottom plate may be secured to a top press section via one or more hinges. A cylindrical rod placed within the magnetizing apparatus may then be used to create a multi-pole magnet.

Novel manufacturing methods and precursor components used in such methods are also disclosed herein. In one example of such a method for manufacturing a magnetic connector apparatus, an outer housing piece may be provided that comprises one or more weld joint protrusions.

In some embodiments, these weld joint protrusions may comprise a V-shaped ridge formed adjacent to at least a portion of a perimeter of the outer housing piece. Alternatively, the weld joint protrusion may comprise another suitable shape, such as, for example, a weld joint protrusion with a relatively flat top and/or relatively parallel sides, rather than the relatively pointed tip and slanted sides of a V-shaped ridge. A second outer housing piece may also be provided. The second outer housing piece may also comprise a weld joint protrusion.

One or both of the outer housing pieces may also be formed with one or more melt chambers. The melt chamber(s) may be positioned adjacent to the weld joint protrusion(s) such that material from the weld joint protrusion(s) will melt into the melt chamber(s) during a welding process, as described in greater detail below. As described below, in preferred embodiments, the welding process may comprise a sonic welding process.

In embodiments in which melt chambers are provided in both of the outer housing pieces, the respective melt chambers may be configured and positioned such that a the first outer housing piece melt chamber is at least substantially aligned with a second outer housing piece melt chamber during the welding process. In such embodiments, material from the weld joint protrusion(s) may fill in the partial melt chambers from both outer housing pieces (together forming a joint melt chamber) such that, when the melted material solidifies, it bonds to both of the outer housing pieces and, in some implementations, an inner retainer piece as well. In some embodiments, the joint melt chamber may be formed by a melt chamber from an upper housing piece, a melt chamber from a lower housing piece, and at least a portion of a surface of the inner retainer piece. One or more of the outer housing pieces and/or inner retainer piece may comprise a suitable material for sonic welding, such as a thermoplastic material, a carbon fiber material, a metallic material, or a composite material, for example.

As described elsewhere herein, one or more magnet housings may also be provided, each of which may contain a magnet therein such that the magnet is rotatable within the magnet housing. The magnet housing(s) may be coupled to at least one of the first outer housing piece, the second outer housing piece, and the inner retainer piece. The first outer housing piece may then be sonically welded to the second outer housing piece and/or the inner retainer piece.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. In particular, an "embodiment" may be a system, an article of manufacture, a method, or a product of a process.

The components of the embodiments, as generally described and illustrated in the figures herein, could be arranged and designed in a wide variety of different configurations. Some of the infrastructure and manufacturing processes that can be used with embodiments disclosed herein are already available. Accordingly, well-known structures and manufacturing processes associated with magnets, connectors, plastics, forms, metals, composites, and the like, have not been shown or described in detail to avoid unnecessarily obscuring descriptions of the present exemplary embodiments. In addition, the steps of the described methods do not necessarily need to be executed in any specific order, or even sequentially, nor need the steps be executed only once, unless otherwise specified.

The embodiments of the disclosure are best understood by reference to the drawings, wherein like parts are designated by like numerals throughout. In the following description, numerous details are provided to give a thorough understanding of various embodiments. However, the embodiments disclosed herein can be practiced without one or more of the specific details, or with other methods, components, materials, etc. In other instances, well-known structures, materials, or operations are not shown or described in detail to avoid obscuring aspects of this disclosure.

FIG. 1A illustrates a multi-pole magnetic assembly 100 configured with four magnetic sections 101, 103, 105, and 107 of alternating polarities. As illustrated, multi-pole magnetic assembly 100 may include a first half 111 and a second half 112 extending along a longitudinal axis 110. First half 111 may comprise a first magnetic section 101 having a first magnetic polarity (north) and a second magnetic section 105 having an opposite magnetic polarity (south). Second half 112 may include a corresponding number of magnetic sections 103 and 107 having a magnetic polarity opposite that of an adjacent magnetic section 101 and 105, respectively, in first half 111.

Figure 1B:
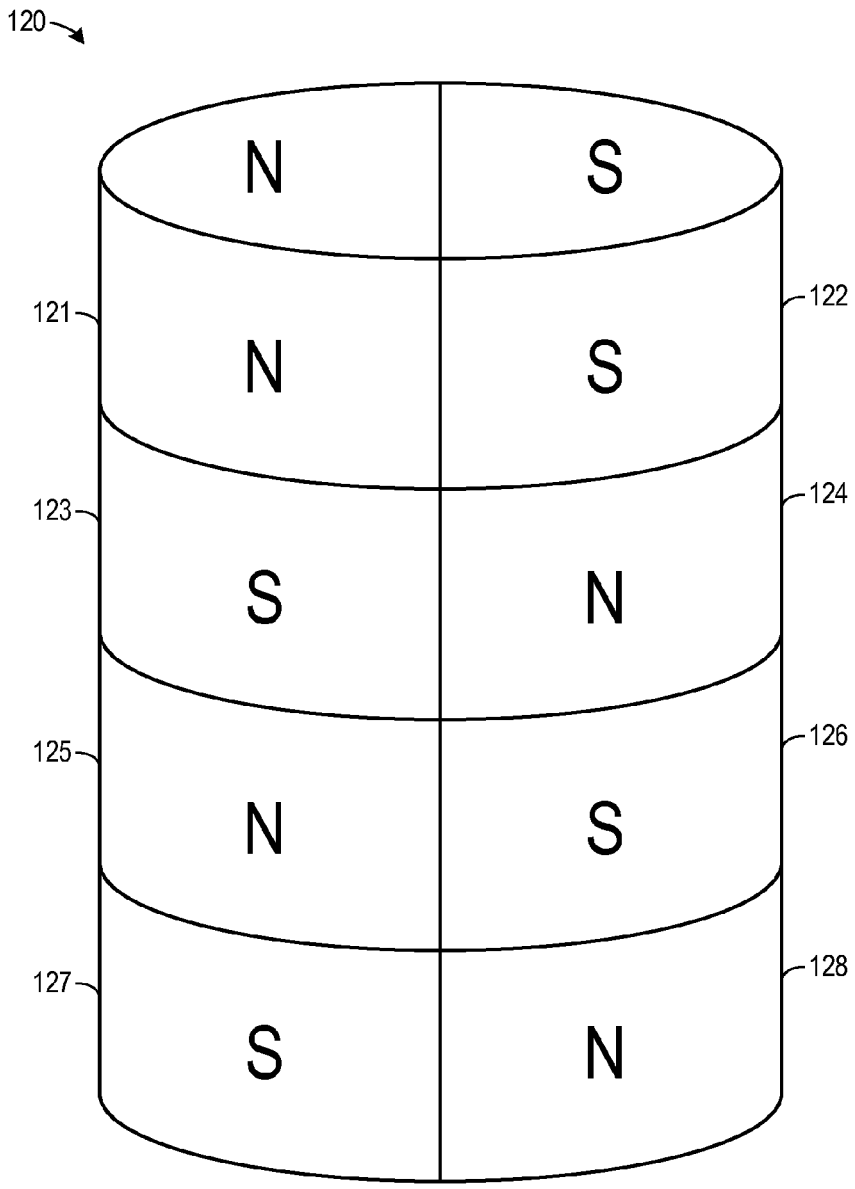
FIG. 1B illustrates a multi-pole magnetic assembly configured with eight magnetic sections of alternating polarities.

FIG. 1B illustrates another embodiment of a multi-pole magnetic assembly 120 similar to that of FIG. 1A. As illustrated, multi-pole magnetic assembly 120 may include eight magnetic sections 121-128, each magnetic section having a magnetic polarity opposite that of each adjacent magnetic section. Again, multi-pole magnetic assembly 120 may include a first half and a second half extending along a longitudinal axis. Each half may include a corresponding number of magnetic sections. As illustrated, a left half may include four magnetic sections 121, 123, 125, and 127 having magnetic polarities north, south, north, south, respectively. A right half may include four corresponding magnetic sections 122, 124, 126, and 128, each having a magnetic polarity opposite that of the adjacent magnetic section in the left half. Accordingly, magnetic sections 122, 124, 126, and 128 may have magnetic polarities south, north, south, north, respectively.

Figure 1C:
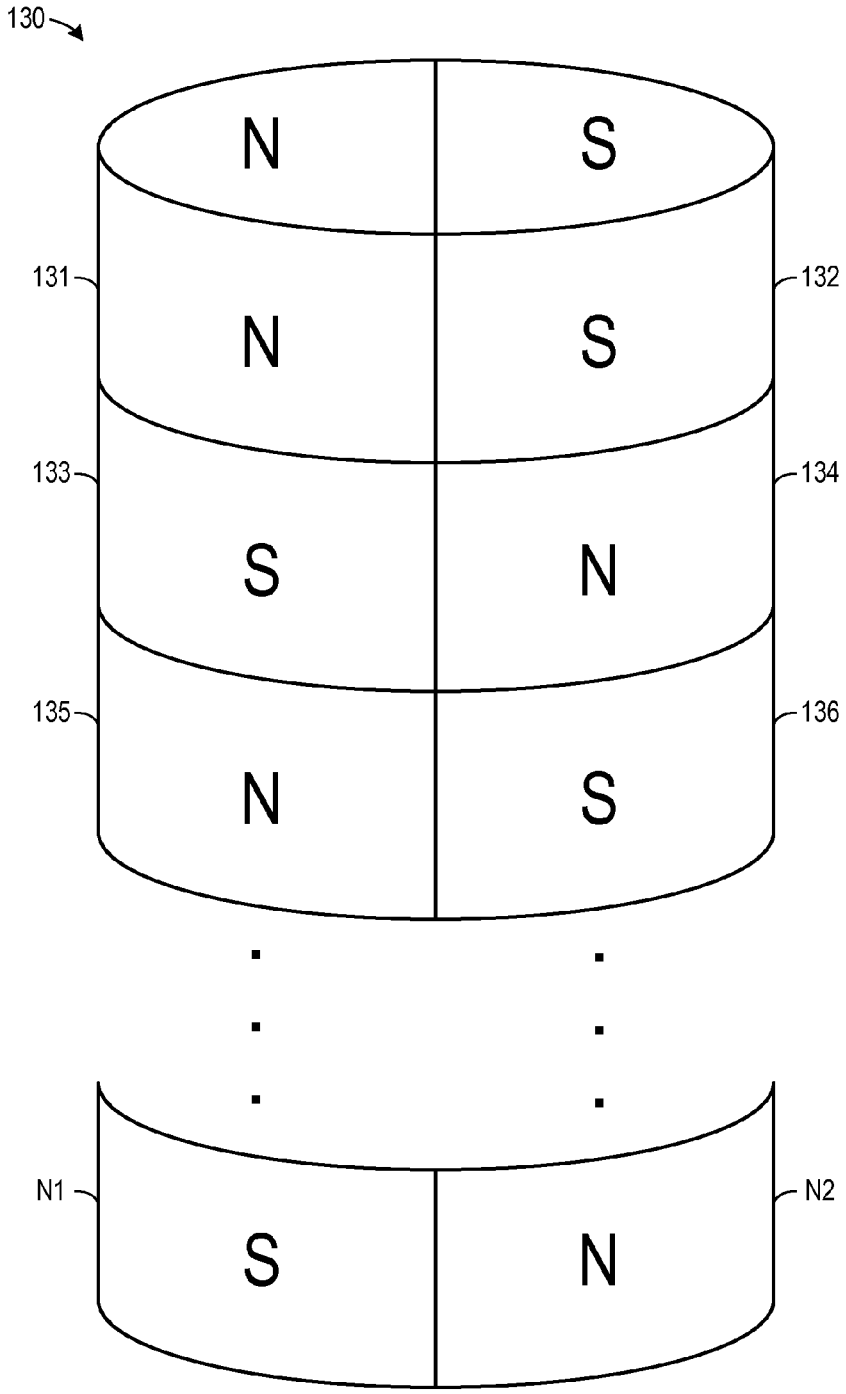
FIG. 1C illustrates a multi-pole magnetic assembly configured with N magnetic sections of alternating polarities.

FIG. 1C illustrates a multi-pole magnetic assembly 130 configured with any number of magnetic sections 131-N2, with each magnetic section having a magnetic polarity opposite that of each adjacent magnetic section. As conveyed by FIG. 1C, a multi-pole magnetic assembly 130 may include any number of magnetic sections as desired. According to various embodiments, a magnetic assembly may include an equal number of magnetic sections with a north polarization as a south polarization. Additionally, the magnetic strength of the magnetic sections having a south polarization may be equal to the magnetic strength of the magnetic sections having a north polarization. According to some embodiments, the volume and/or mass of the magnetic sections having a south polarization may be less than or greater than the volume and/or mass of the magnetic sections having a north polarization.

According to some embodiments, the adjacent oppositely polarized magnetic sections may strengthen or otherwise modify the magnetic fields of other magnetic sections. In some embodiments, the assemblies may be configured such that the magnetic field of one or more outer magnetic sections magnify the magnetic field of one or more of the center magnetic sections. For example, magnetic section 134 may have an increased magnetic flux adjacent thereto due to the interaction of magnetic flux from adjacent magnetic sections 132 and 136. This may lead to the inner magnetic sections having greater lifting strength than the outer magnetic sections.

Figure 2:
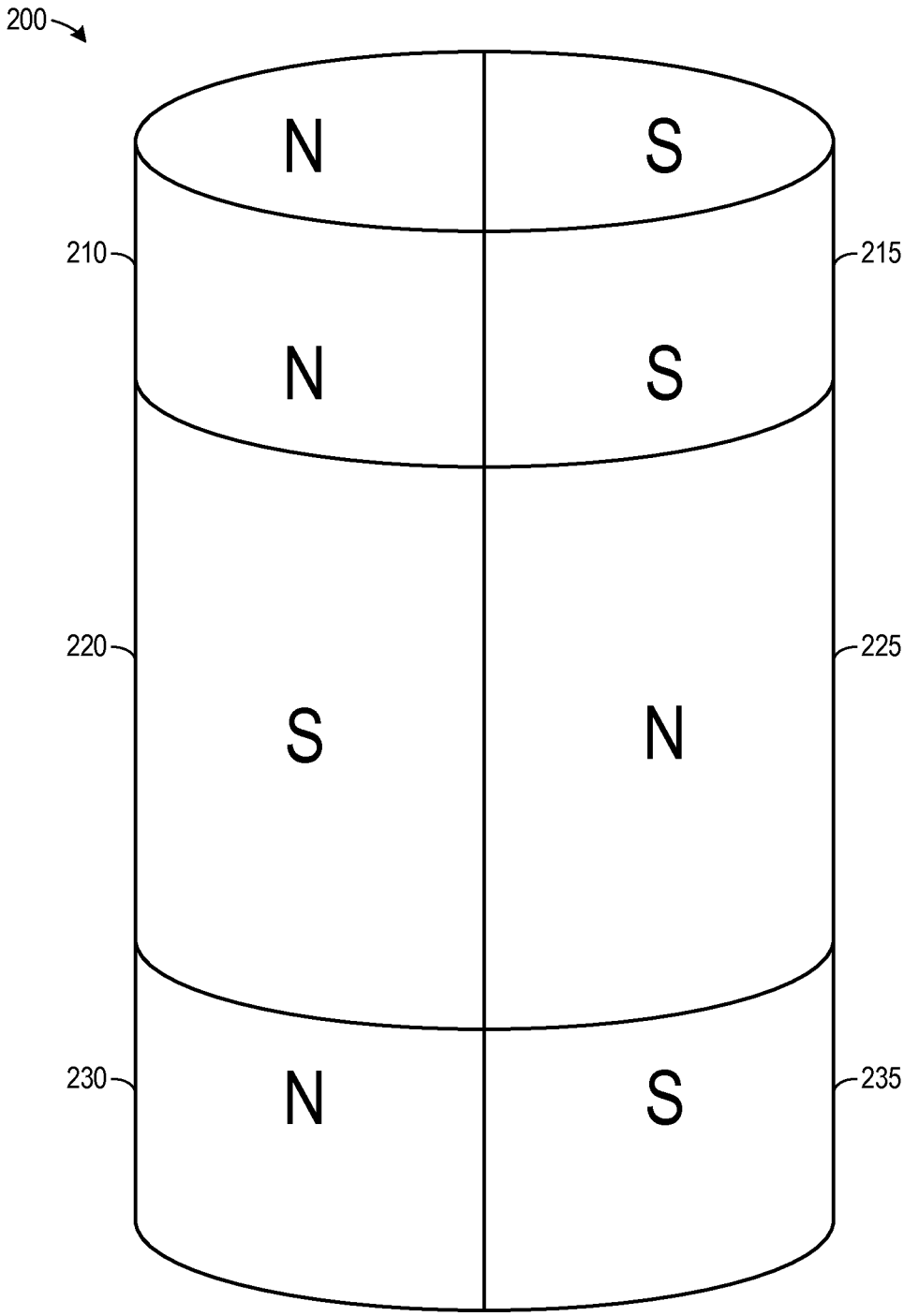
FIG. 2 illustrates a multi-pole magnetic assembly configured with six magnetic sections of alternating polarities, including relatively larger center sections.

FIG. 2 illustrates a multi-pole magnetic assembly 200 configured with six magnetic sections 210-235, each magnetic section having a magnetic polarity opposite that of each adjacent magnetic section. As illustrated, magnetic sections 220 and 225 may be configured with opposite polarities (south and north, respectively) and may be physically larger magnetic sections than magnetic sections 210, 215, 230, and 235. According to some embodiments, magnetic sections 220 and 225 may have a stronger magnetic strength than magnetic sections 210, 215, 230, and 235. Alternatively, any magnetic section or pair of magnetic sections having opposite polarities may have a stronger magnetic strength than another magnetic section or pair of magnetic sections, independent of physical shape, volume, weight, or dimensions.

Figure 3A:
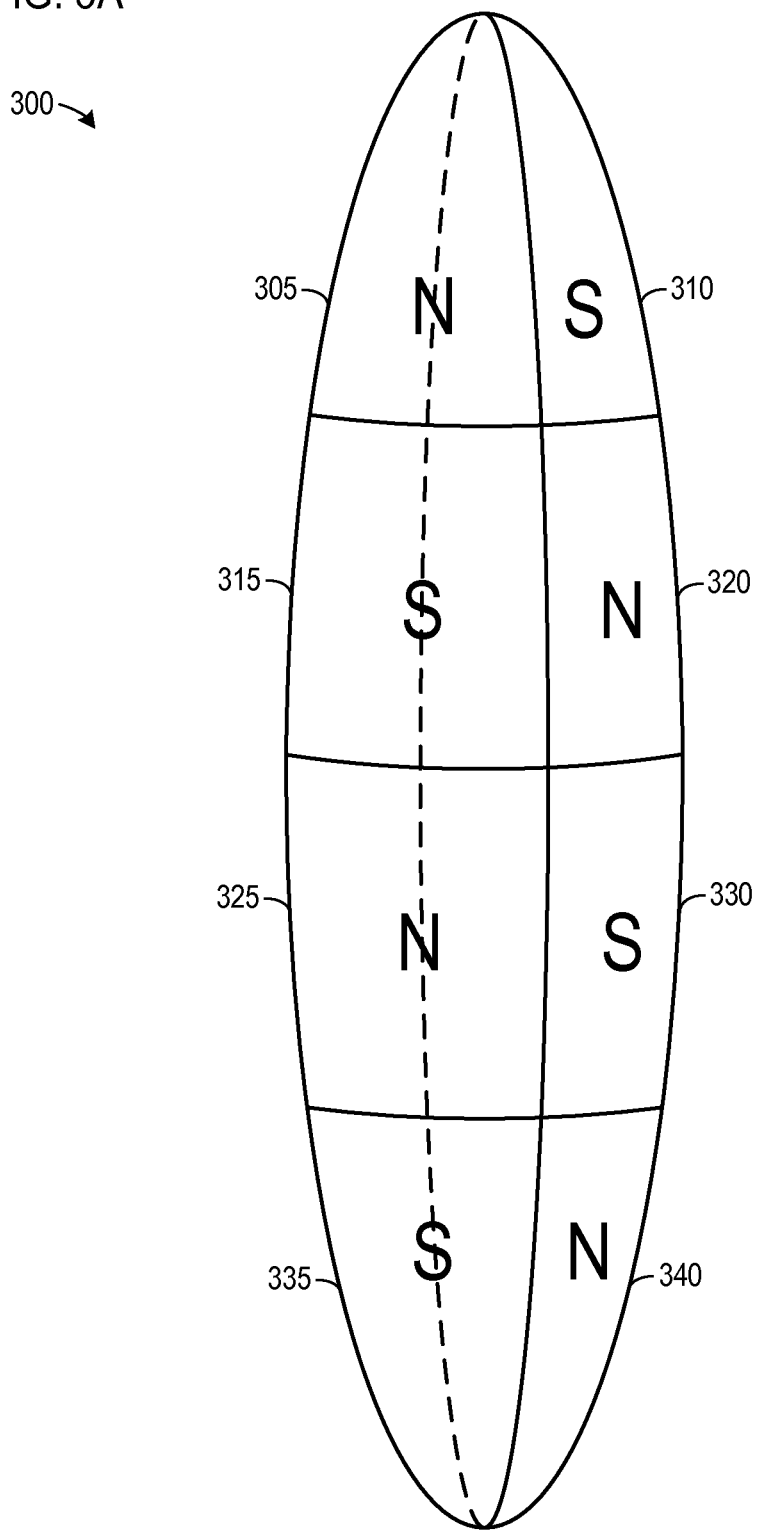
FIG. 3A illustrates a multi-pole magnetic assembly configured with eight magnetic sections of alternating polarities in an oblong configuration.
Figure 3B:
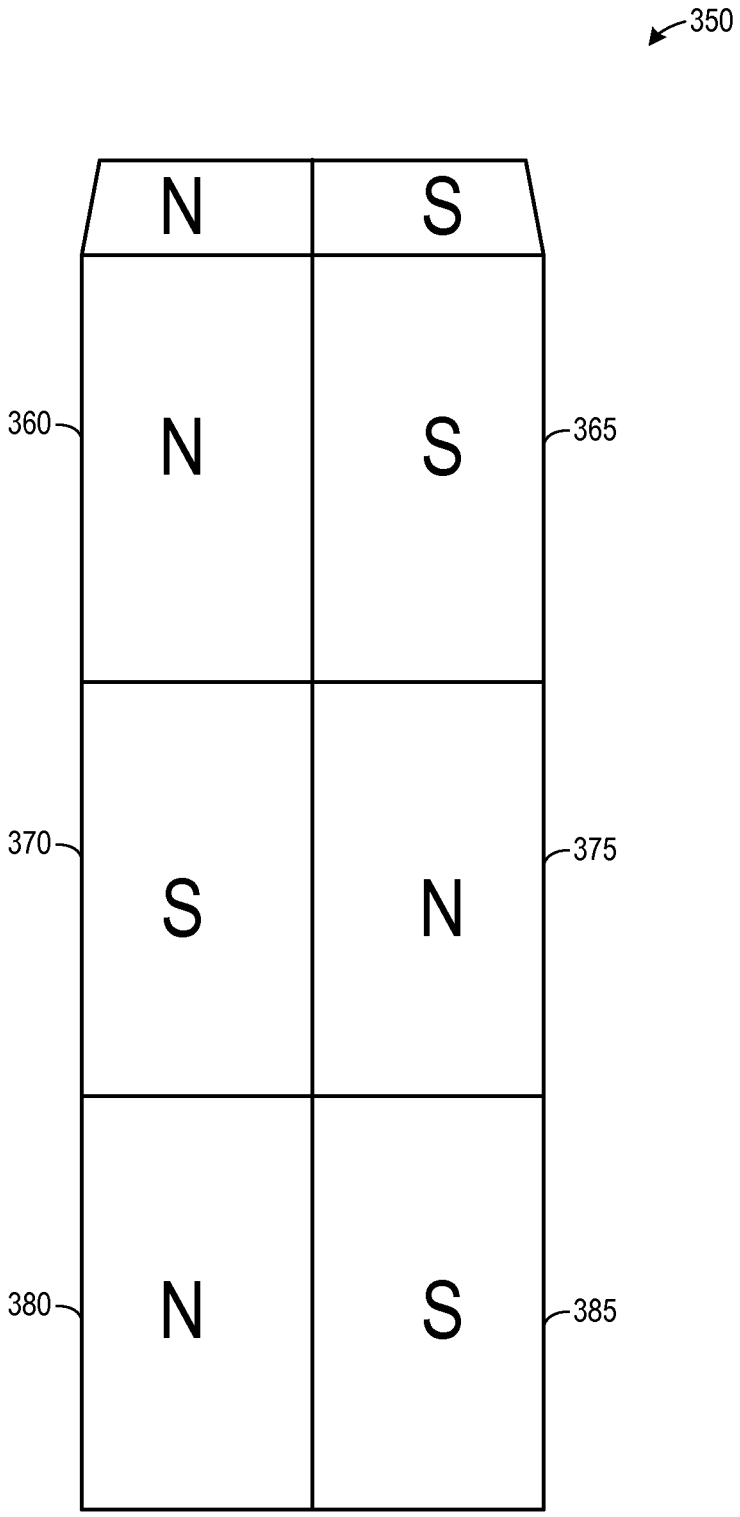
FIG. 3B illustrates a multi-pole magnetic assembly configured with six magnetic sections of alternating polarities in a rectangular prism configuration.

FIGS. 1A-2 illustrate various embodiments of multi-pole magnetic assemblies 100, 120, 130, and 200 having cylindrical configurations. As illustrated in FIGS. 3A and 3B, a multi-pole magnetic assembly may be any shape or size. FIG. 3A illustrates a multi-pole magnetic assembly 300 configured with eight magnetic sections 305-340 each having a magnetic polarity opposite that of each adjacent magnetic section. As illustrated, multi-pole magnetic assembly 300 may be in an oblong, or egg-shaped configuration. The length, width, height, and/or contour of the perimeter of multi-pole magnetic assembly 300 may be adapted or modified as is deemed suitable for a particular application.

Providing another alternative configuration, FIG. 3B illustrates a multi-pole magnetic assembly 350 configured with six magnetic sections 360-385, each having a magnetic polarity opposite that of each adjacent magnetic section. Multi-pole magnetic assembly 350 is a rectangular prism configuration. According to various embodiments, the length, width, and height of magnetic assembly 350 may be adapted for a particular application.

The various embodiments of multi-pole magnetic assemblies described in conjunction with FIGS. 1A-3B are merely illustrative and are not the only contemplated shapes, sizes, or configurations. Additional shapes and sizes of multi-pole magnetic assemblies are contemplated having any of a wide variety of shapes and sizes, including any polygonal regular or irregular prismic, circular cylindrical, and/or elliptical cylindrical shape. Prismic multi-pole magnetic assemblies may include bases at right angles, obtuse angles, and/or acute angles. Moreover, the perimeter may be irregular and/or include a non-flat base, such as the oblong multi-pole magnetic assembly illustrated in FIG. 3A.

A multi-pole magnetic assembly may be formed using any of a wide variety of magnetizable materials. A multi-pole magnetic assembly may be a single continuous magnetic material including a plurality of adjacent magnetic sections each polarized with a magnetic polarity opposite that of each adjacent magnetic section. Alternatively, a multi-pole magnetic assembly may be a single physical material including a plurality of adjacent magnetic sections each polarized with a magnetic polarity opposite that of each adjacent magnetic section, where each pair of oppositely polarized magnetic sections is separated from another pair of oppositely polarized magnetic sections by a non-magnetically polarized section of material. According to yet another embodiment, a multi-pole magnetic assembly may be formed by joining multiple pairs of oppositely polarized magnetic sections. In such an embodiment, a multi-pole magnetic assembly may include a plurality of magnets polarized along their longitudinal axes magnetically linked end to end, such that each magnetic section is magnetically polarized opposite that of each adjacent magnetic section.

Figure 4:
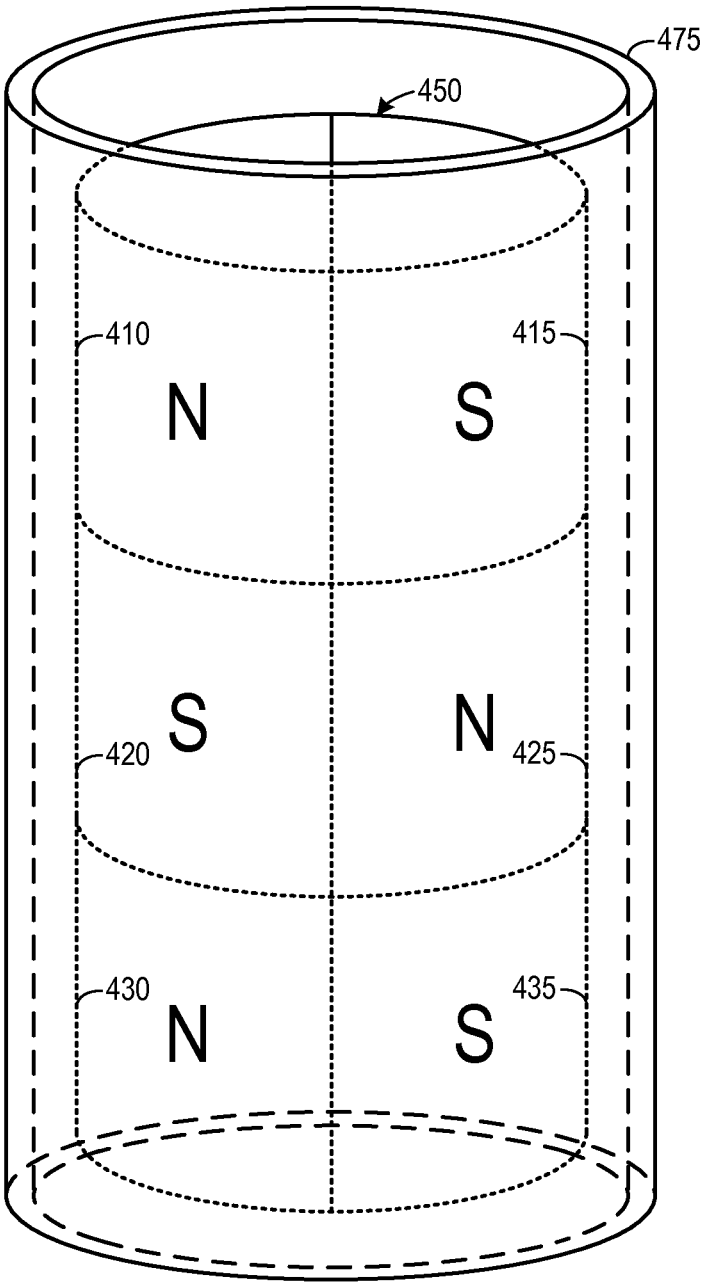
FIG. 4 illustrates a cylindrical multi-pole magnetic assembly encased within a cylindrical enclosure.

FIG. 4 illustrates a cylindrical multi-pole magnetic assembly 450 encased within a connection member comprising a cylindrical enclosure 475. As illustrated, multi-pole magnetic assembly 450 may include six magnetic sections 410-435, each magnetic section 410-435 having a magnetic polarity opposite that of each adjacent magnetic section. According to various embodiments, cylindrical enclosure 475 may be a circular cylinder, as illustrated, or may be an elliptical cylinder. Multi-pole magnetic assembly 450 may be free to translate within cylindrical enclosure 475 along a longitudinal axis, or may be longitudinally fixed. Additionally, multi-pole magnetic assembly 450 may be free to rotate about its longitudinal axis within cylindrical enclosure 475, or may be fixedly secured within cylindrical enclosure 475.

Other embodiments are contemplated in which an enclosure is not necessary. For example, a rod may be positioned to extend through a central axis of one or more magnetic assemblies to facilitate the rotation. Such a rod may be positioned within a cavity or opening positioned within the magnetic connector apparatus if desired.

Figure 5:
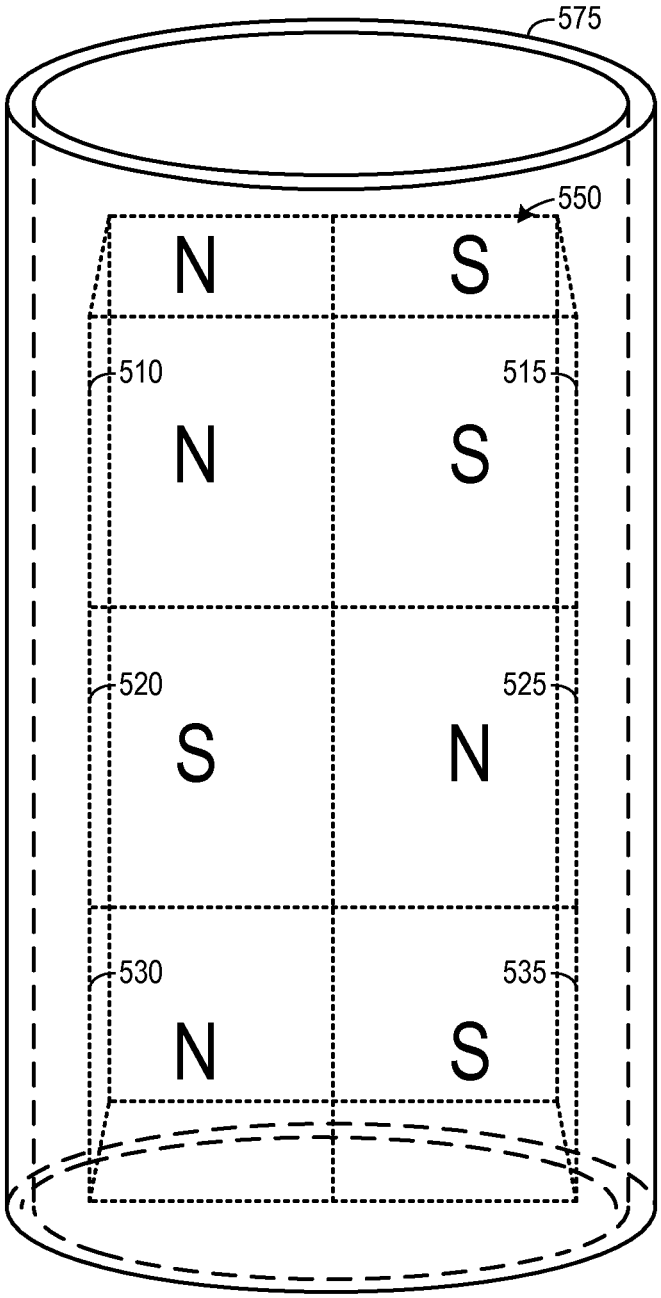
FIG. 5 illustrates a rectangular prismic multi-pole magnetic assembly encased within a cylindrical enclosure.

FIG. 5 illustrates a rectangular prismic multi-pole magnetic assembly 550 encased within a connection member comprising a cylindrical enclosure 575. Rectangular prismic multi-pole magnetic assembly 550 may include six magnetic sections 510-535, each magnetic section 510-535 having a magnetic polarity opposite that of each adjacent magnetic section. According to various embodiments, cylindrical enclosure 575 may be a circular cylinder, as illustrated, or may be an elliptical cylinder. Multi-pole magnetic assembly 550 may be free to translate within cylindrical enclosure 575 along a longitudinal axis, or may be longitudinally fixed. Multi-pole magnetic assembly 550 may be free to rotate about its longitudinal axis within cylindrical enclosure 575, or may be fixedly secured within cylindrical enclosure 575.

Figure 6:
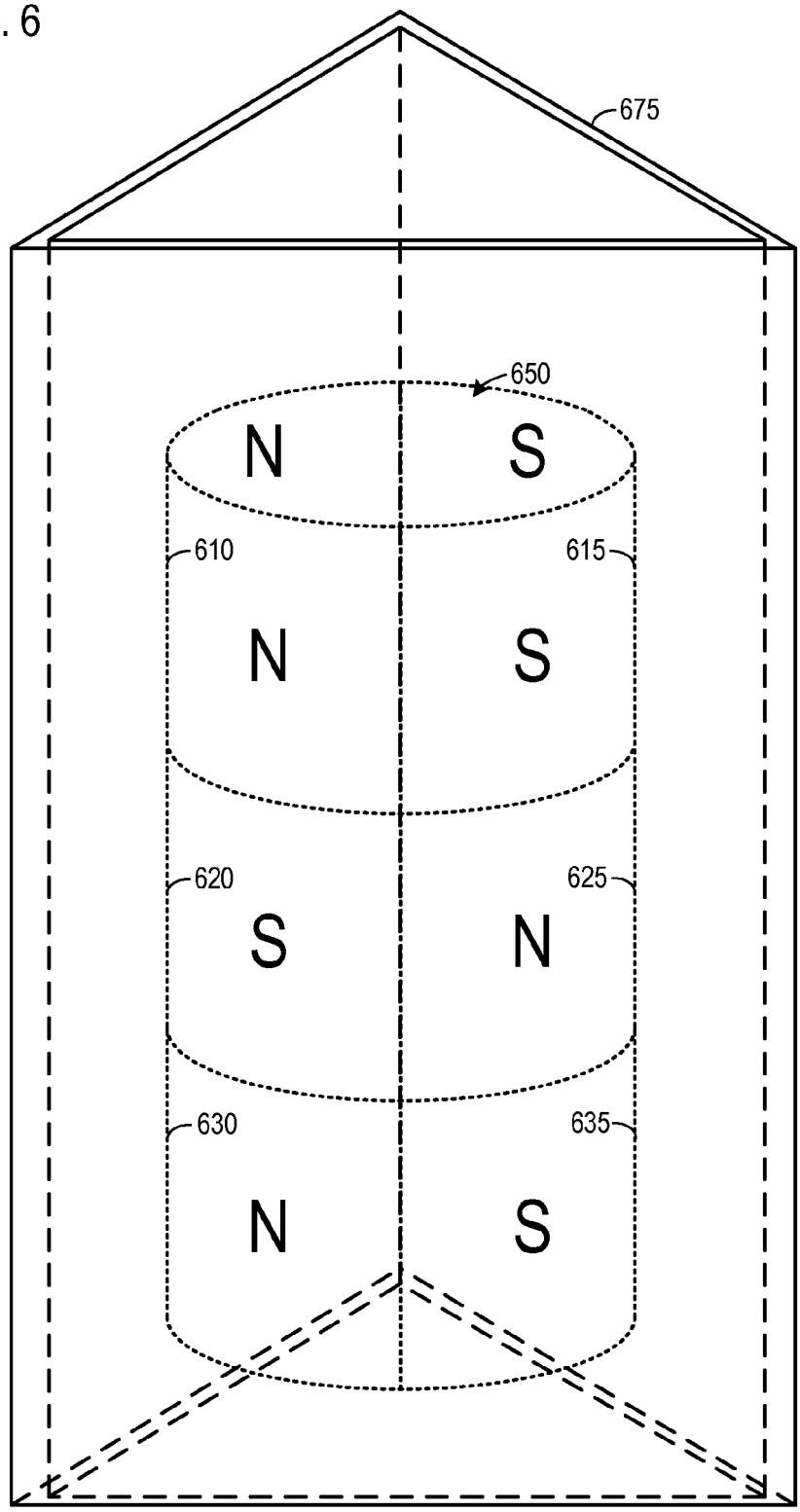
FIG. 6 illustrates a cylindrical multi-pole magnetic assembly encased within a triangular prismic enclosure.

FIG. 6 illustrates a cylindrical multi-pole magnetic assembly 650 encased within a connection member comprising a triangular prismic enclosure 675. Multi-pole magnetic assembly 650 may include six magnetic sections 610-635, each magnetic section 610-635 having a magnetic polarity opposite that of each adjacent magnetic section. According to various embodiments, triangular prismic enclosure 675 may be modified to be any polygonal prismic enclosure having any number of sides, dimensions, heights, and/or base angles. Multi-pole magnetic assembly 650 may be free to translate within prismic enclosure 675 along a longitudinal axis, or may be longitudinally fixed. Multi-pole magnetic assembly 650 may be free to rotate about its longitudinal axis within prismic enclosure 675, or may be fixedly secured within prismic enclosure 675.

Figure 7A:
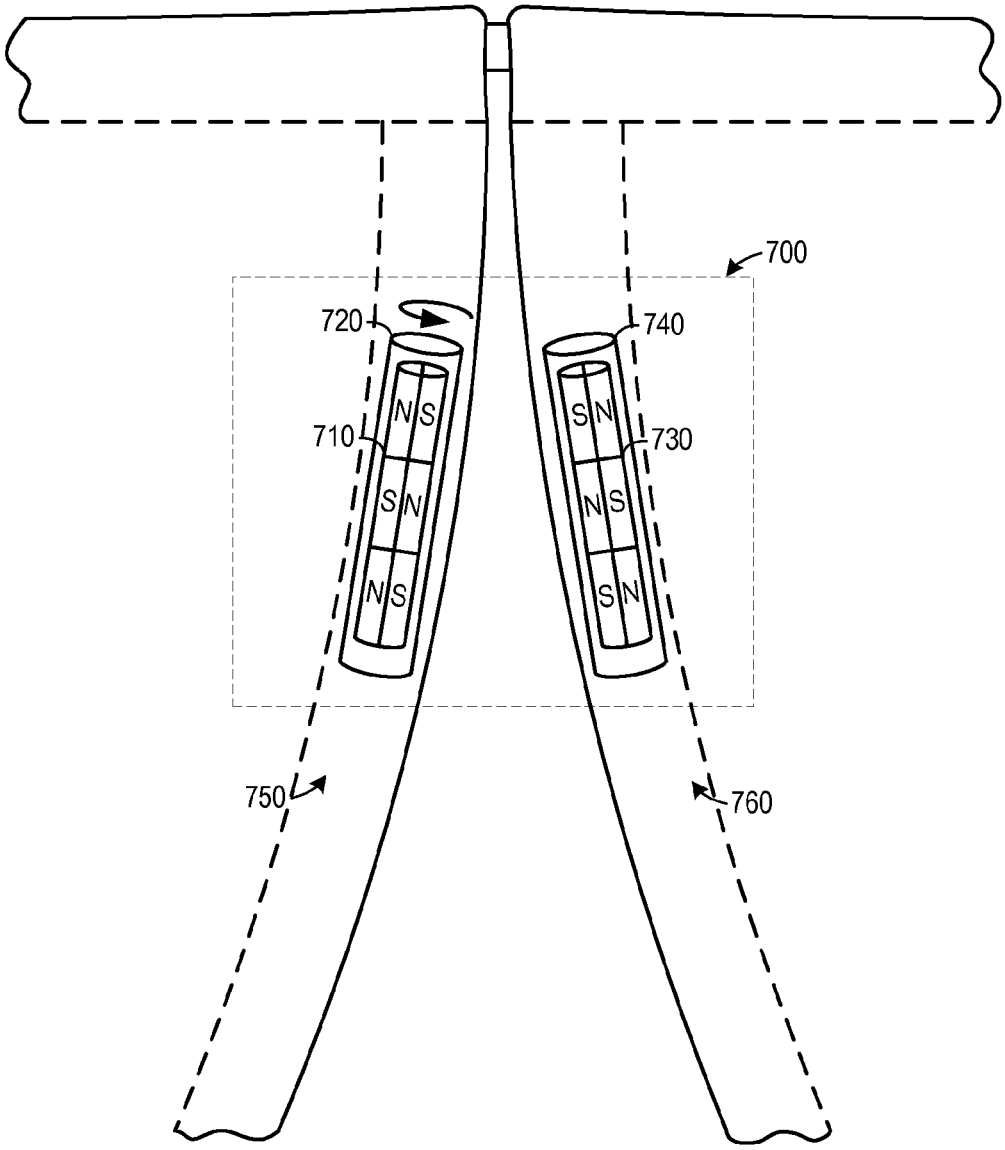
FIG. 7A illustrates a connector apparatus including two cylindrical multi-pole magnetic assemblies configured to rotatably align polarities in order to magnetically link two sections of a fabric.

FIG. 7A illustrates a connector apparatus 700 comprising two cylindrical multi-pole magnetic assemblies 710 and 730 configured to rotatably align polarities in order to magnetically link two connection members comprising sections 750 and 760 of a fabric. As illustrated, each multi-pole magnetic assembly 710 and 730 may be encased within an enclosure 720 and 740, respectively. As illustrated, the polarities of the magnetic sections of multi-pole magnetic assembly 710 are not aligned with the magnetic sections of multi-pole magnetic assembly 730. Accordingly, in the orientation illustrated in FIG. 7A, multi-pole magnetic assemblies 710 and 730 would repel one another.

According to various embodiments, the repulsion of the magnetic sections of multi-pole magnetic assemblies 710 and 730 may cause one or both of multi-pole magnetic assemblies 710 and 730 to rotate about a longitudinal axis in order to align the polarities of the magnetic sections of each of multi-pole magnetic assemblies 710 and 730. This rotation may comprise a rotation of the magnetic assemblies within a fixed enclosure or, alternatively, may comprise a rotation of the enclosures themselves, as described in greater detail below. The transition from FIG. 7A to FIG. 7B illustrates multi-pole magnetic assembly 710 rotating about its longitudinal axis in order to magnetically link with multi-pole magnetic assembly 730.

According to some embodiments, multi-pole magnetic assembly 710 may rotate about a longitudinal axis within and with respect to enclosure 720. In such an embodiment, multi-pole magnetic assembly and enclosure combinations 710, 720 and 730, 740 may be fixedly attached to fabric sections 750 and 760. Alternatively, multi-pole magnetic assembly 710 may be fixed within enclosure 720, and enclosure 720 may be configured to rotate about its longitudinal axis in order to align the magnetic sections of each of multi-pole magnetic assemblies 710 and 730. In such an embodiment, Multi-pole magnetic assembly and enclosure combinations 710, 720 and 730, 740 may be rotatably secured within a hem or other cavity of fabric sections 750 and 760.

Figure 7B:
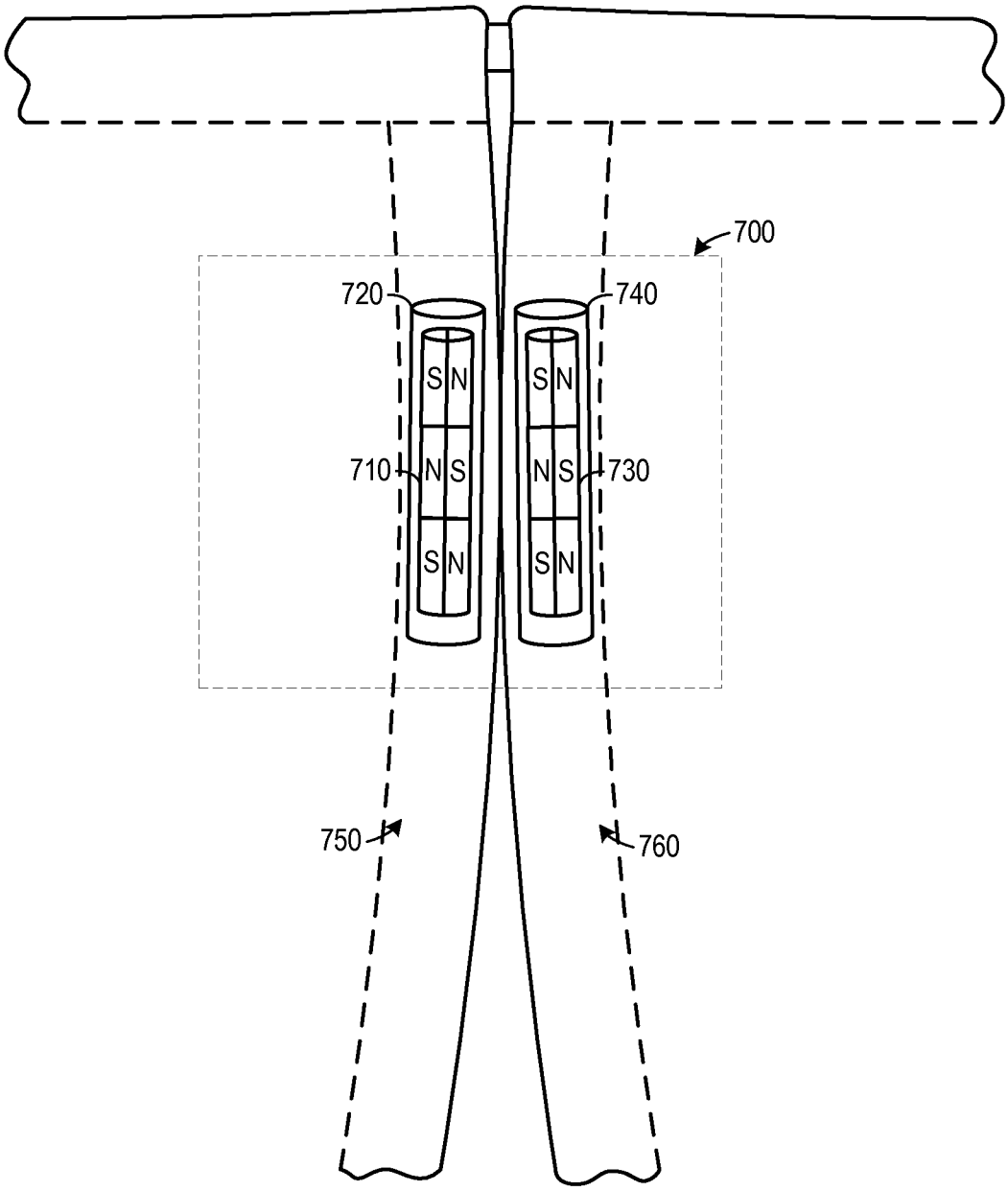
FIG. 7B illustrates a connector apparatus including two cylindrical multi-pole magnetic assemblies with aligned polarities magnetically linking the two sections of fabric.

FIG. 7B illustrates a connector apparatus 700 comprising the two cylindrical multi-pole magnetic assembly and enclosure combinations 710, 720 and 730, 740. As illustrated, with the magnetic sections of each of multi-pole magnetic assemblies 710 and 730 aligned, multi-pole magnetic assembly and enclosure combinations 710, 720 and 730, 740 may magnetically link with one another, and thereby link fabric sections 750 and 760. In addition to linking fabric, such as fabric sections 750 and 760, one or more multi-pole magnetic assembly and enclosure combinations, such as multi-pole magnetic assembly and enclosure combinations 710, 720 and 730, 740, may be used to magnetically link any of a wide variety of materials, components, or products.

Figure 8A:
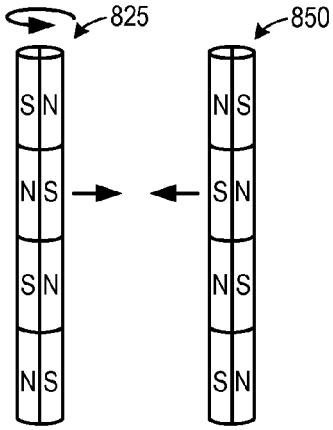
FIGS. 8A-8B illustrate a first multi-pole magnetic assembly rotating about a longitudinal axis to align the polarities of its magnetic sections with those of a second multi-pole magnetic assembly.

FIG. 8A illustrates a first multi-pole magnetic assembly 825 and a second multi-pole magnetic assembly 850. In this embodiment, each of the first and second multi-pole magnetic assemblies 825 and 850 include eight magnetic sections. Each magnetic section may have a magnetic polarity opposite that of each adjacent magnetic section. As second multi-pole magnetic assembly 850 approaches first multi-pole magnetic assembly 825, first multi-pole magnetic assembly 825 may rotate to align the polarities of the respective magnetic sections of first and second multi-pole magnetic assemblies 825 and 850 so that they may magnetically link.

Figure 8B:
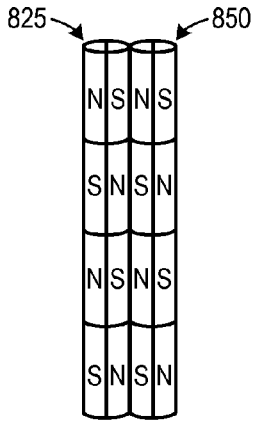

As illustrated in FIG. 8B, the rotation of first multi-pole magnetic assembly 825 about its longitudinal axis may align the polarities of its magnetic sections with those of the second multi-pole magnetic assembly. Once the polarities are properly aligned, first and second multi-pole magnetic assemblies 825 and 850 may magnetically link along aligned outside perimeters. In an alternative embodiment, second multi-pole magnetic assembly 850 may rotate in addition to, or instead of, first multi-pole magnetic assembly 825.

Figure 8C:
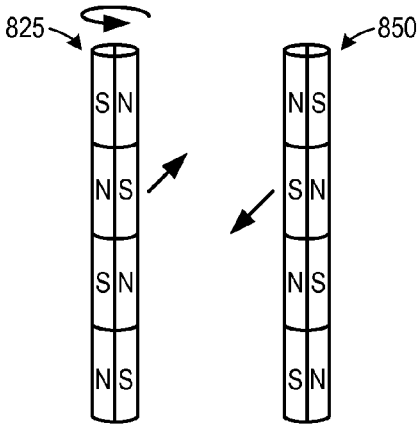
FIGS. 8C-8D illustrate the first multi-pole magnetic assembly rotating about its longitudinal axis in order to magnetically link with the second multi-pole magnetic assembly longitudinally askew along an outer perimeter.
Figure 8D:
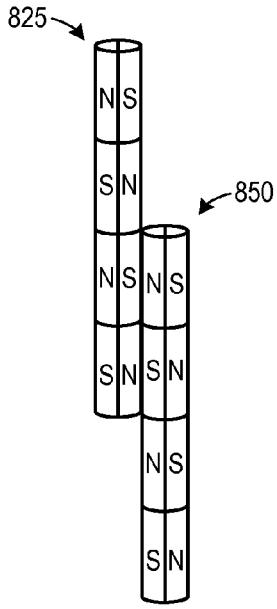

FIGS. 8C-8D illustrate first multi-pole magnetic assembly 825 rotating about its longitudinal axis in order to magnetically link with second multi-pole magnetic assembly 850 along askew outer perimeters. As illustrated in FIG. 8C, first multi-pole magnetic assembly 825 may rotate about its longitudinal axis in order to properly align the respective magnetic sections of first and second multi-pole magnetic assemblies 825 and 850.

One result of using multi-pole magnetic assemblies, as opposed to bi-pole magnets, is that two or more multi-pole magnetic assemblies may be magnetically linked along outer perimeters that are longitudinally askew with respect to one another. As illustrated in FIG. 8D, first multi-pole magnetic assembly 825 may be magnetically linked to second multi-pole magnetic assembly 850 longitudinally askew by two magnetic sections. In other embodiments, first multi-pole magnetic assembly 825 may include any number of magnetic sections, and second multi-pole magnetic assembly 850 may be magnetically linked along longitudinally askew outer perimeters by one or more magnetic sections.

FIGS. 9A-9G illustrate a first multi-pole magnetic assembly 925 and a second multi-pole magnetic assembly 950 rotatably interacting and maintaining a magnetic link while second multi-pole magnetic assembly 950 is translated along a longitudinal axis with respect to first multi-pole magnetic assembly 925. Beginning with FIG. 9A, first multi-pole magnetic assembly 925 may be magnetically linked with second multi-pole magnetic assembly 950 along aligned outer perimeters. Though illustrated as cylindrical herein, first and second multi-pole magnetic assemblies 925 and 950 may be cylindrical, spherical, oblong, rectangular, parallelepiped, trapezoidal, and/or any other suitable shape. Moreover, first and second multi-pole magnetic assemblies 925 and 950 may each include a first half and a second half extending along a longitudinal axis, each half including any number of magnetic sections having magnetic polarities opposite that of each adjacent magnetic section. As illustrated in FIGS. 9A-9G, each multi-pole magnetic assembly 925 and 950 includes eight magnetic sections of alternating polarities.

Figure 9A:
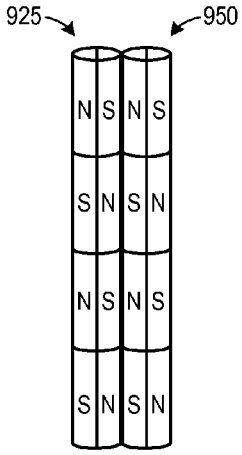
FIGS. 9A-9G illustrate a first multi-pole magnetic assembly and a second multi-pole magnetic assembly rotatably interacting and maintaining a magnetic link while the second multi-pole magnetic assembly is longitudinally translated along the outer perimeter of the first multi-pole magnetic assembly.
Figure 9B:
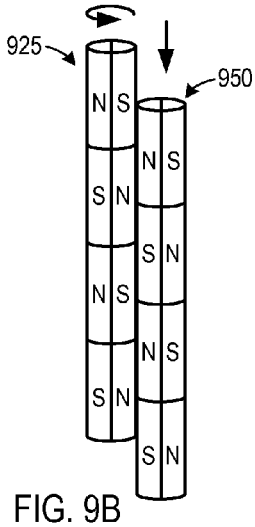
Figure 9C:
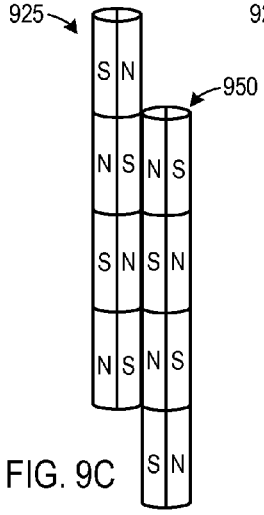

In FIG. 9B, second multi-pole magnetic assembly 950 is longitudinally translated along an outer perimeter of first multi-pole magnetic assembly 925. As the polarities of the respective magnetic sections become misaligned, first multi-pole magnetic assembly 925 may rotate in order to maintain the proper polarity alignment. Once first multi-pole magnetic assembly 925 has rotated, second multi-pole magnetic assembly 950 may be magnetically linked longitudinally askew by one magnetic section, as illustrated in FIG. 9C. Alternatively, second multi-pole magnetic assembly 950 may rotate to maintain the proper polarity alignment.

Figure 9D:
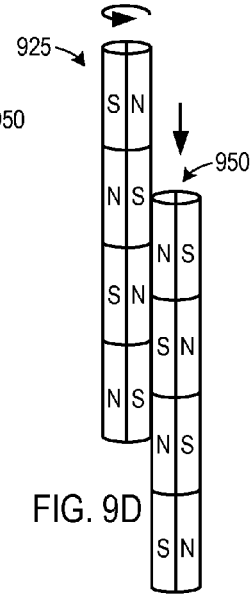
Figure 9E:
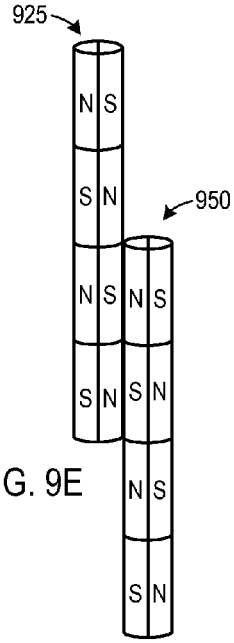

Continuing with FIG. 9D, second multi-pole magnetic assembly 950 may be further longitudinally translated with respect to first multi-pole magnetic assembly 925. Again, as the polarities of the respective magnetic sections become misaligned, first multi-pole magnetic assembly 925 may rotate in order to maintain the proper polarity alignment for first and second multi-pole magnetic assemblies 925 and 950 to remain magnetically linked. As illustrated in FIG. 9E, first and second multi-pole magnetic assemblies 925 and 950 remain magnetically linked longitudinally askew by two magnetic sections.

Figure 9F:
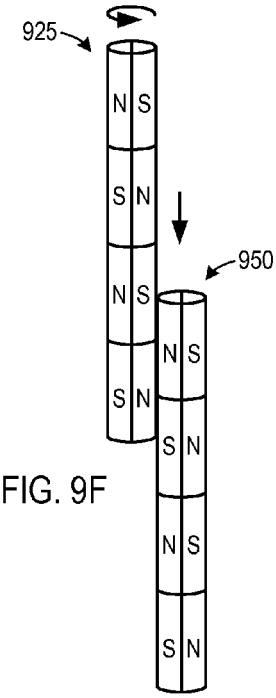
Figure 9G:
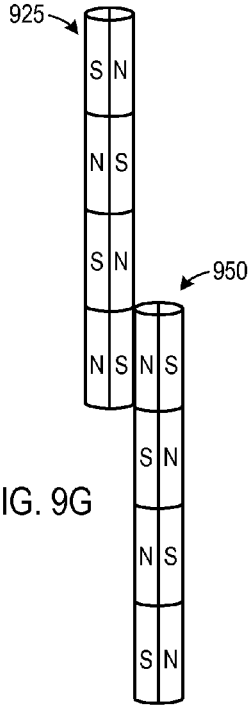

FIG. 9F illustrates second multi-pole magnetic assembly 950 as it is further translated with respect to first multi-pole magnetic assembly 925. First multi-pole magnetic assembly 925 may rotate again in order to maintain an attractive polarity alignment between the respective magnetic sections of first and second multi-pole magnetic assemblies 925 and 950. As illustrated in FIG. 9G, first and second multi-pole magnetic assemblies 925 and 950 may remain magnetically linked along askew outer perimeters, such that a single magnetic section from each multi-pole magnetic assembly 925 and 950 maintains the magnetic link.

It should be understood from the discussion accompanying FIGS. 8A-8D and 9A-9F that various embodiments of the multi-pole magnetic assemblies disclosed herein may have a plurality of individual connection points with respect to an adjacent multi-pole magnetic assembly. Typically, each such assembly will have as many connection points as there are pairs of magnetic sections.

Figure 10A:
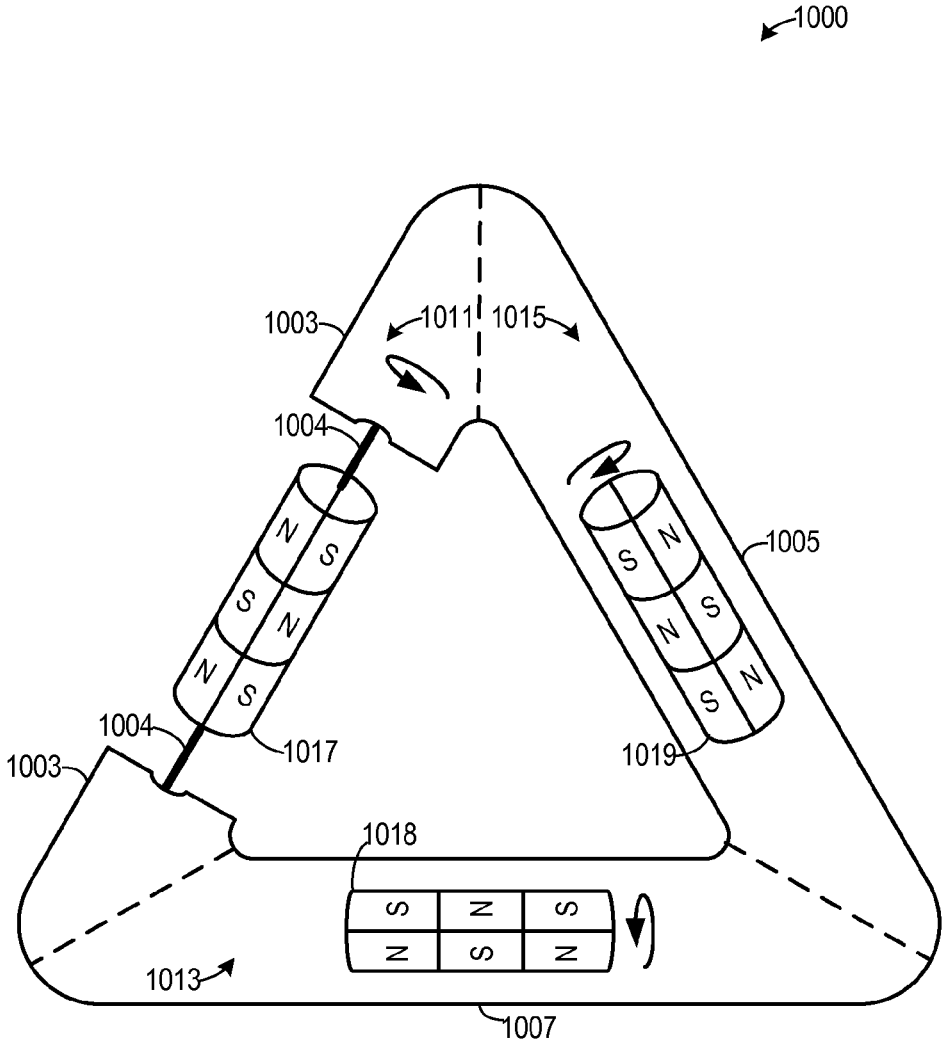
FIG. 10A illustrates a connection member including three connection edges forming a triangular framework, including a multi-pole magnetic assembly adjacent each connection edge.

FIG. 10A illustrates a connection apparatus comprising a connection member 1000. Connection member 1000 comprises three connection edges 1003, 1005, and 1007. Connection edge 1003 comprises an open region comprising a connection rod 1004. Connection rod 1004 extends through a central axis of multi-pole magnetic assembly 1017 and allows multi-pole magnetic assembly 1017 to rotate around the connection rod 1004. In some embodiments, rod 1004 may comprise an upper rod section and a lower rod section, and may be connected to a central axis of multi-pole magnetic assembly 1017, but not extend all of the way therethrough. Additionally, instead of an open region, connection rod 1004 may be positioned within a cavity formed within a connection member.

Connection member 1000 also comprises two other connection edges 1005 and 1007, each of which encloses a multi-pole magnetic assembly 1018 and 1019 in an enclosure 1013 and 1015, respectively. Each of the connection edges together make up a triangular configuration. As illustrated in FIG. 10A, each multi-pole magnetic assembly 1017, 1018, and 1019 may be configured to rotate about its longitudinal axis. Thus, each connection edge 1003, 1005 and 1007 of triangle 1000 may include a multi-pole magnetic assembly 1017, 1018, and 1019 adapted to rotate about its longitudinal axis. The multi-pole magnetic assembly 1017, 1018, and 1019 may rotate adjacent the connection edge 1003, 1005 and 1007 of triangle 1000 and align the polarities of each of its magnetic sections with those of another multi-pole magnetic assembly. Accordingly, triangle 1000 may be magnetically linked at any angle with another triangle with a similar configuration as triangle 1000, or another magnetic connector apparatus of another configuration, along any of sides 1003, 1005 and 1007.

Figure 10B:
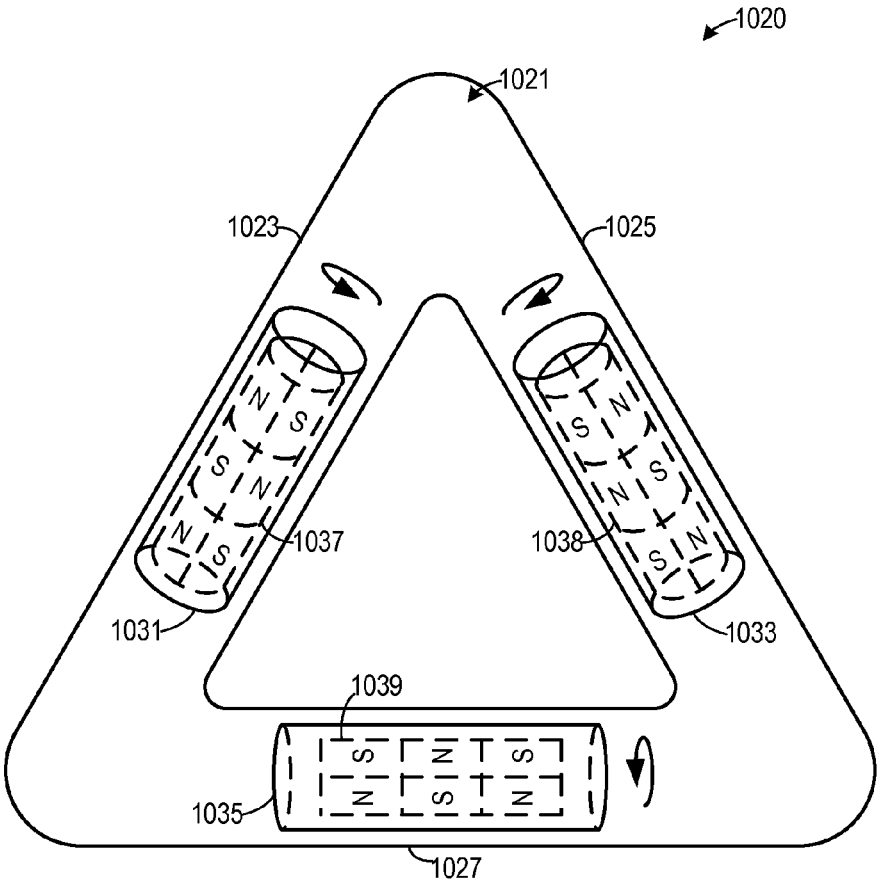
FIG. 10B illustrates a connection member including three connection edges forming a triangular framework, including a magnetic assembly and enclosure combination adjacent each connection edge.

FIG. 10B illustrates a connection member 1020 comprising three connection edges or sides 1023, 1025 and 1027 in a triangular configuration, including a magnetic assembly and enclosure combination 1037, 1031 and 1038, 1033 and 1039, 1035 adjacent each connection edge. According to various embodiments, multi-pole magnetic assemblies 1037, 1038, and 1039 may be cylindrical, prismic, and/or another shape. Enclosures 1031, 1033, and 1035 may be cylindrical, prismic and/or another shape. For example, magnetic assemblies 1037, 1038, and 1039 may be configured as spherical magnetic assemblies having two or more magnetic sections. In such an embodiment, enclosures 1031, 1033, and 1035 may be configured as corresponding spheres or cylinders adapted to encase the spherical magnetic assemblies.

Magnetic assemblies 1037, 1038, and 1039 may be configured to rotate within and with respect to enclosures 1031, 1033, and 1035. Alternatively, magnetic assemblies 1037, 1038, and 1039 may be fixed within enclosures 1031, 1033, and 1035. In such an embodiment, magnetic assemblies 1037, 1038, and 1039 may be configured to rotate about their longitudinal axes. In either embodiment, enclosures 1031, 1033, and 1035 may rotate about their longitudinal axes to align the polarities of each magnetic section of each magnetic assembly 1037, 1038, and 1039 with another magnetic assembly in order to magnetically link a side 1023, 1025 and 1027 with another object containing a similar magnetic assembly, such as another triangle similar to triangular connection member 1020.

Figure 10C:
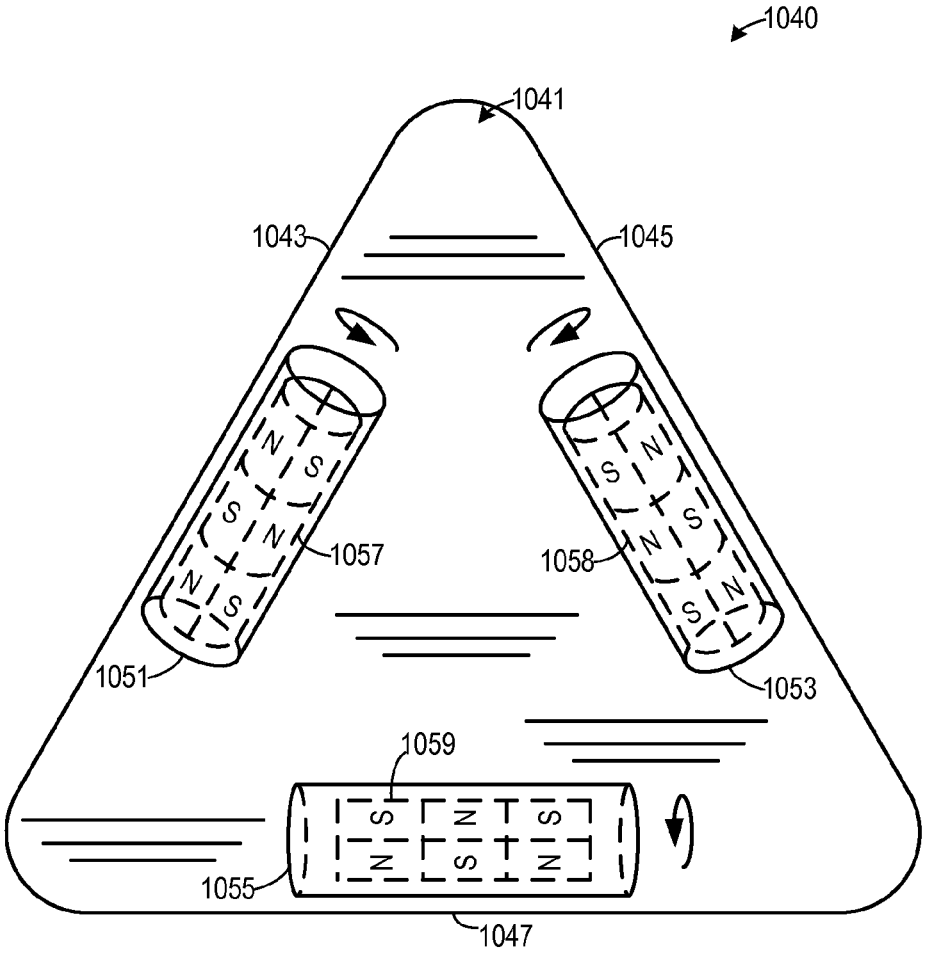
FIG. 10C illustrates a connection member including three connection edges in a triangular configuration, including a magnetic assembly and enclosure combination adjacent each connection edge.

FIG. 10C illustrates a connection member 1040 comprising three connection edges in a triangular configuration, including a magnetic assembly and enclosure combination 1057, 1051 and 1058, 1053 and 1059, 1055 adjacent each connection edge 1043, 1045, and 1047. Similar to previously described embodiments, magnetic assemblies 1057, 1058, and 1059 may be configured to rotate within and with respect to enclosures 1051, 1053, and 1055. Alternatively, magnetic assemblies 1057, 1058, and 1059 may be fixed within enclosures 1051, 1053, and 1055. In such an embodiment, enclosures 1051, 1053, and 1055 may be configured to rotate about their longitudinal axes. In still another embodiment, enclosures 1051, 1053, and 1055 may be omitted and magnetic assemblies 1057, 1058, and 1059 may be configured to rotate about their longitudinal axes within cavities or hollows adjacent sides 1043, 1045, and 1047 of triangular connection member 1040.

Figure 10D:
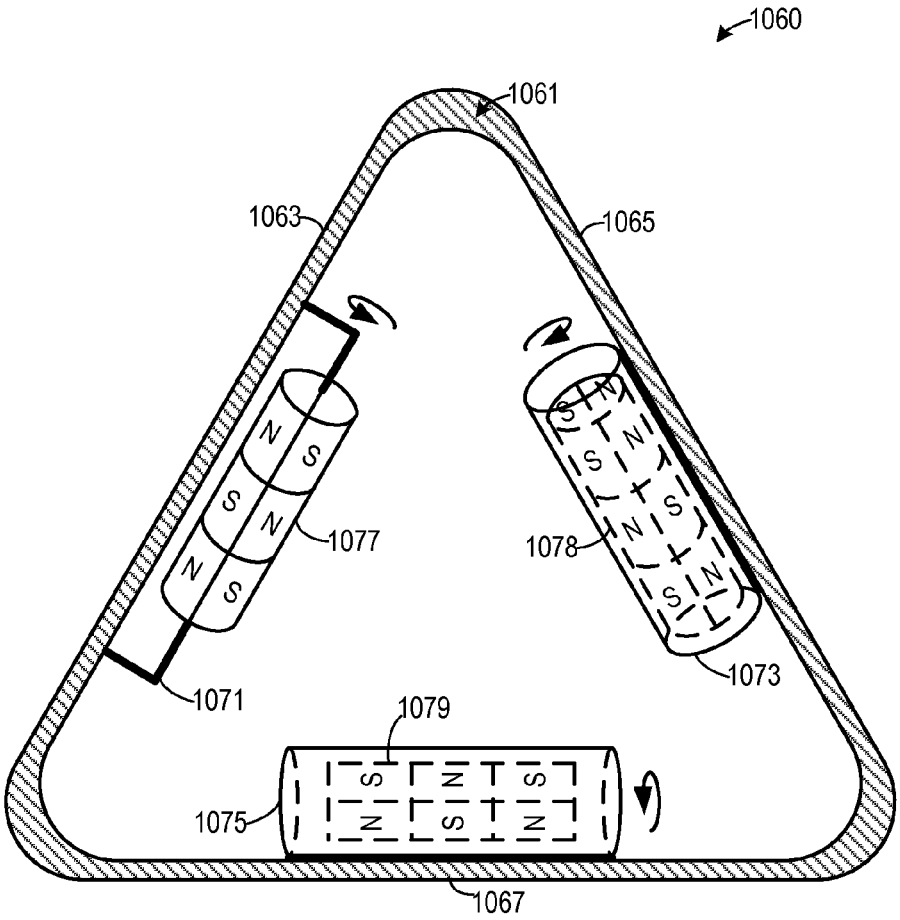
FIG. 10D illustrates a connection member including three connection edges in a triangular framework, including a rotatable multi-pole magnetic assembly adjacent each connection edge.

FIG. 10D illustrates a connection member 1060 comprising three connection edges 1063, 1065, and 1067 in a triangular framework. A magnetic assembly and enclosure combination 1078, 1073 and 1079, 1075 may be fixedly attached to each of connection edges 1065 and 1067. According to the illustrated embodiment, enclosures 1073 and 1075 may be fixedly attached to an inner or outer portion of each side section 1065 and 1067. Magnetic assemblies 1078 and 1079 may be configured to rotate within and with respect to enclosures 1073 and 1075, so as to align the polarities of each magnetic section of each magnetic assembly 1078 and 1079 in order to magnetically link respective connection edges 1065 and 1067 with another object containing a similar magnetic assembly, such as another triangle similar to triangular connection member 1060. Alternatively, a magnetic connector apparatus of another configuration, such as one having only a single edge or connection member, may be connected with the magnetic connector apparatus configured as triangular framework 1060, or any of the other magnetic connector apparatus disclosed herein. As shown in the figure, connection edge 1063 comprises a connection rod 1071 that is attached to, and substantially parallel to, but offset from, connection edge 1063. Multi-pole magnetic assembly 1077 may be configured to rotate about connection rod 1071 in order to magnetically link connection edge 1063 with a connection edge of another object.

Figure 11:
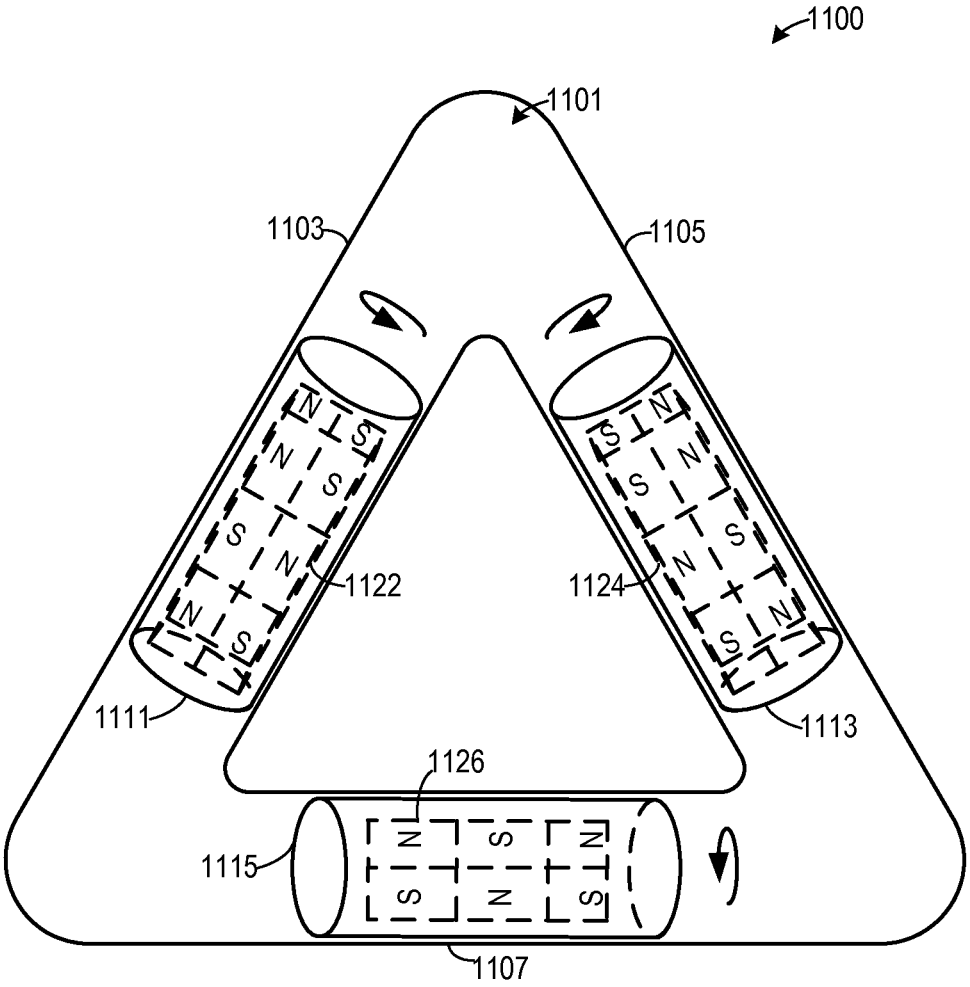
FIG. 11 illustrates a connection member including three connection edges in a triangular configuration, each connection edge including a cylindrical enclosure encasing a rectangular prismic multi-pole magnetic assembly.

FIG. 11 illustrates a connection member 1100 comprising three connection edges or sides 1103, 1105, and 1107 in a triangular configuration, each connection edge 1103, 1105, and 1107 including a cylindrical enclosure 1111, 1113, and 1115 encasing a rectangular prismic multi-pole magnetic assembly 1122, 1124, and 1126. According to various embodiments, rectangular prismic multi-pole magnetic assemblies 1122, 1124, and 1126 may not easily rotate within enclosures 1111, 1113, and 1115 or may be fixedly attached within enclosures 1111, 1113, and 1115. Accordingly, enclosures 1111, 1113, and 1115 may be configured to rotate within each side 1103, 1105, and 1107, so as to allow the polarities of each magnetic section of each multi-pole magnetic assembly 1122, 1124, and 1126 to align with the magnetic sections of other multi-pole magnetic assemblies.

Figure 12:
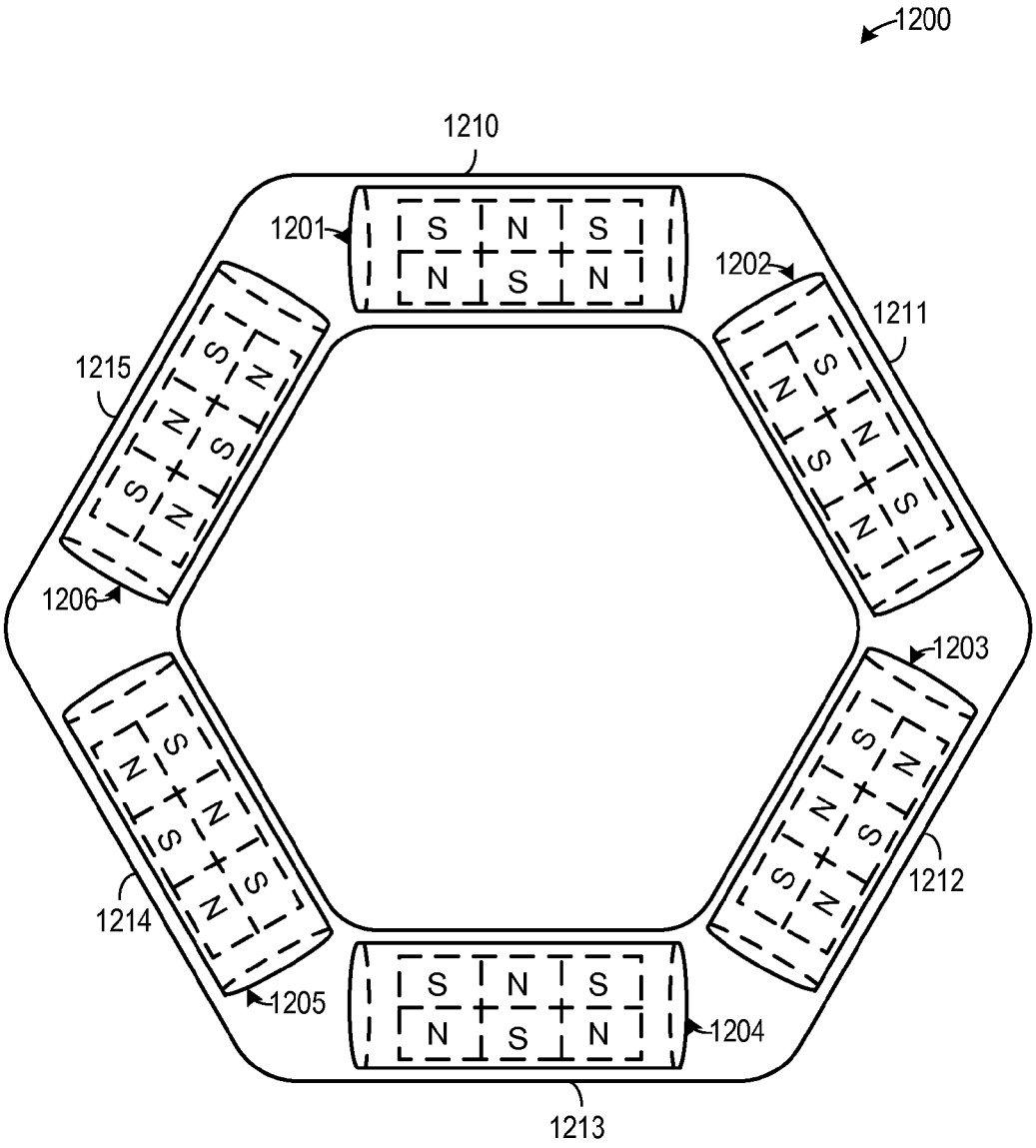
FIG. 12 illustrates a connection member including six connection edges in a hexagonal configuration, including a magnetic assembly and enclosure combination encased adjacent each connection edge.

FIG. 12 illustrates a connection member comprising six connection edges 1210-1215 in a hexagonal configuration 1200, including a magnetic assembly and enclosure combination 1201-1206 adjacent each connection edge 1210-1215. As previously described, the multi-pole magnetic assembly within each magnetic assembly and enclosure combination 1201-1206 may be configured to rotate with or, alternatively, with respect to its corresponding enclosure.

Figure 13A:
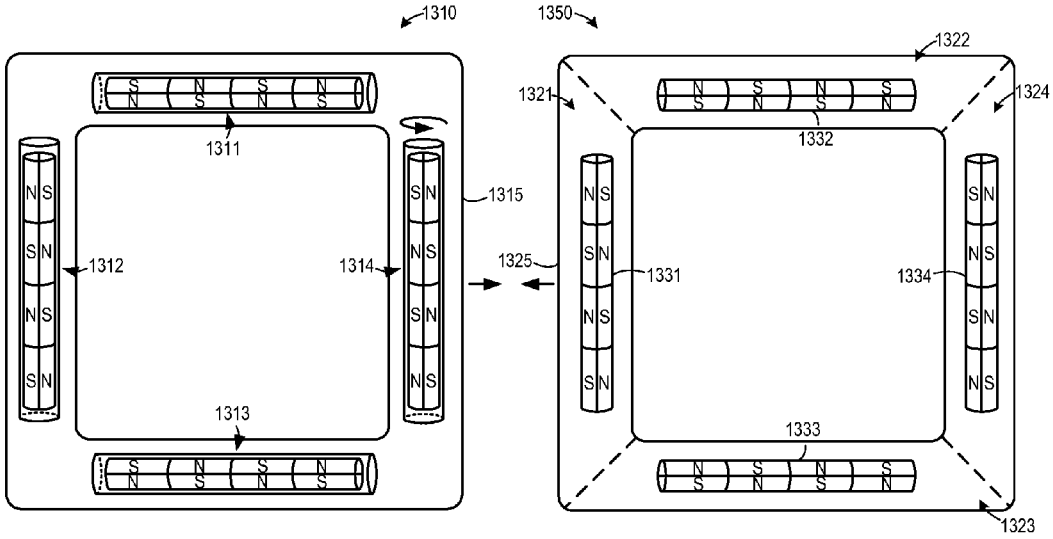
FIG. 13A illustrates a first connector apparatus including a first connection member having four connection edges arranged in a rectangular configuration, and a second connector apparatus having four connection edges arranged in a rectangular configuration.

FIG. 13A illustrates a first connector apparatus 1310 comprising a first connection member having four connection edges arranged in a rectangular configuration, and a second connector apparatus 1350 comprising a second connection member having four connection edges 1321-1324. As illustrated, each of the four connection edges, or sides, of first connector apparatus 1310 may encase a magnetic assembly and enclosure combination 1311-1314. According to various embodiments, the multi-pole magnetic assemblies encased within each magnetic assembly and enclosure combination 1311-1314 may be may be cylindrical, prismic, and/or another suitable shape. Similarly, the enclosures themselves may be cylindrical, prismic and/or another shape.

Second connector apparatus 1350 may comprise four enclosures 1321-1324, each encasing a multi-pole magnetic assembly 1331-1334. Enclosures 1321-1324 may be shaped such that they can be connected end to end and form any number of polygonal shapes. Each multi-pole magnetic assembly 1331-1334 may rotate within its respective enclosure 1321-1324 about a longitudinal axis.

Figure 13B:
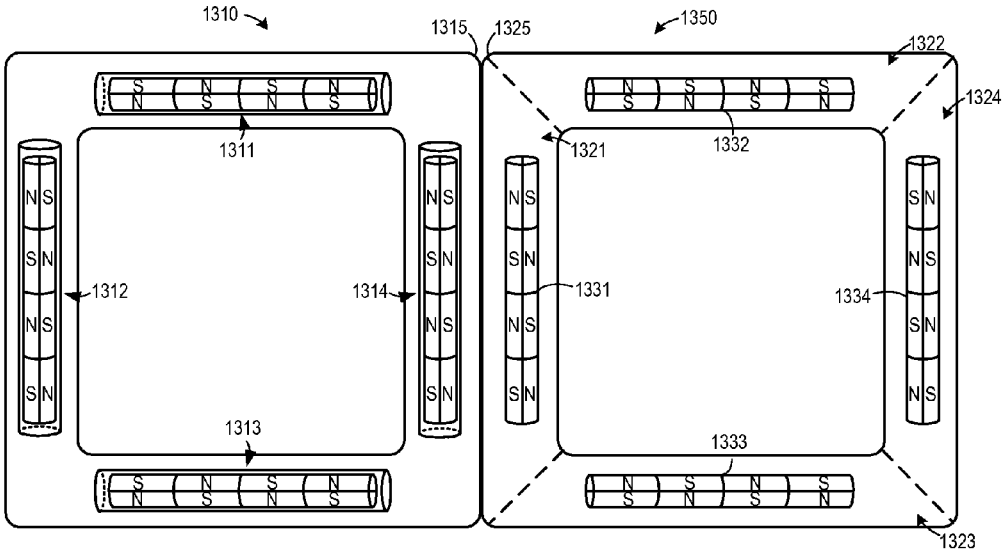
FIG. 13B illustrates the first and second connector apparatus magnetically linked along aligned outer perimeters.

As illustrated in FIG. 13A, as first and second connector apparatus 1310 and 1350 approach one another, the multi-pole magnetic assembly within magnetic assembly and enclosure combination 1314 may rotate to align the respective magnetic sections of magnetic assembly and enclosure combination 1314 and multi-pole magnetic assembly 1331. Once the magnetic sections are aligned, first and second connector apparatus 1310 and 1350 may be magnetically linked along longitudinally aligned outer perimeters 1315 and 1325, as illustrated in FIG. 13B. Alternatively, either the multi-pole magnetic assembly 1331 alone, or the enclosure in magnetic assembly and enclosure combination 1314, may rotate about a longitudinal axis in order to align the respective magnetic sections.

Figure 14A:
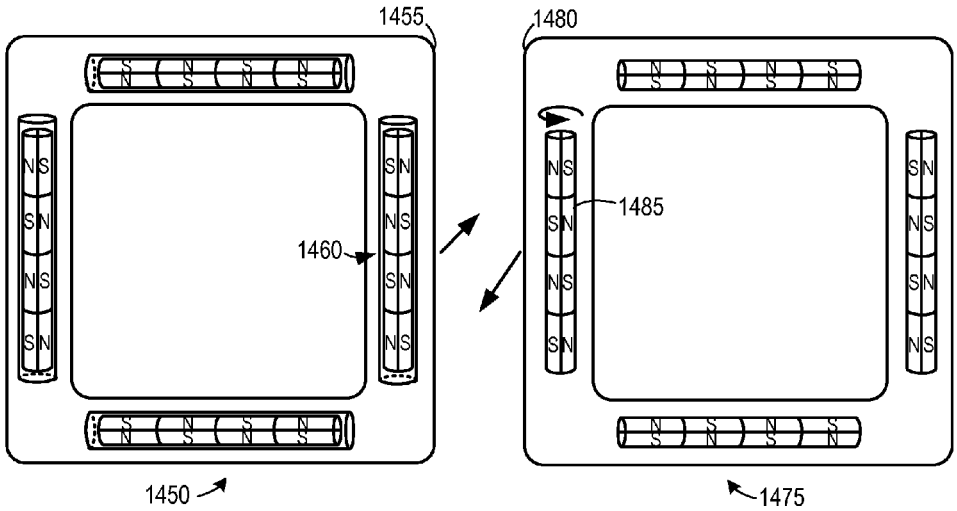
FIGS. 14A-14B illustrate a multi-pole magnetic assembly adjacent a connection edge of a connection member rotating in order to magnetically link with a second connector apparatus along askew outer perimeters.

FIG. 14A illustrates a multi-pole magnetic assembly 1485 rotating within a second connector apparatus 1475 in order to magnetically link with a first connector apparatus 1450 along longitudinally askew outer perimeters 1455 and 1480. According to various embodiments, multi-pole magnetic assembly 1485 may rotate in order to align the respective magnetic sections of multi-pole magnetic assembly 1485 and the multi-pole magnetic assembly within magnetic assembly and enclosure combination 1460. According to alternative embodiments, either the multi-pole magnetic assembly within the enclosure of magnetic assembly and enclosure combination 1460 or the enclosure of combination 1460 may rotate along a longitudinal axis instead of multi-pole magnetic assembly 1485.

Figure 14B:
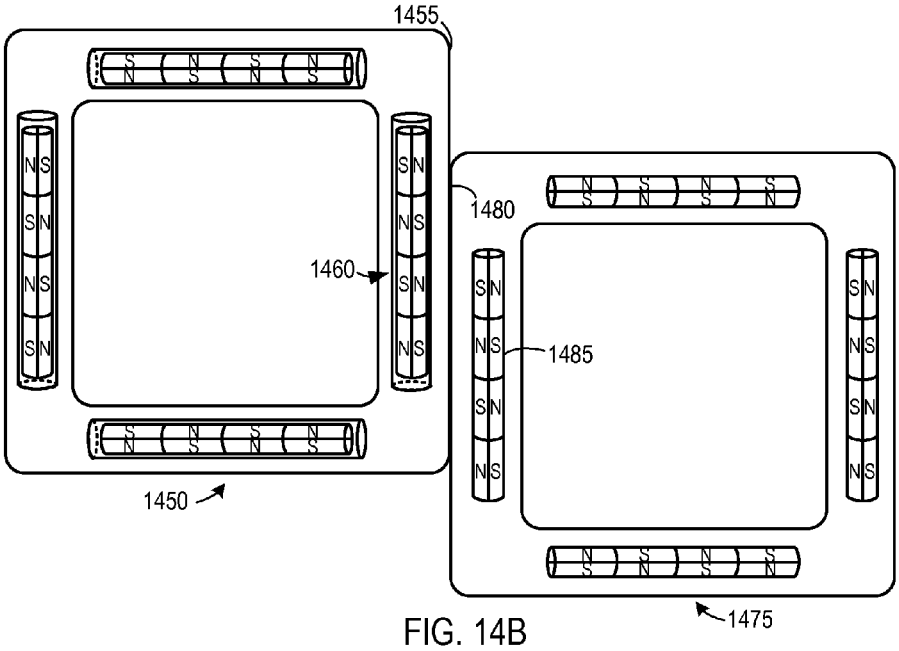

As illustrated in FIG. 14B, since each multi-pole magnetic assembly within each of first and second connector apparatus 1450 and 1475 includes multiple pairs of magnetic sections (as opposed to just one pair), first and second connector apparatus 1450 and 1475 may magnetically link along longitudinally askew outer perimeters 1455 and 1480, which, as discussed above, results in four separate connection points along each of the sides of the two connector apparatus.

Figure 15A:
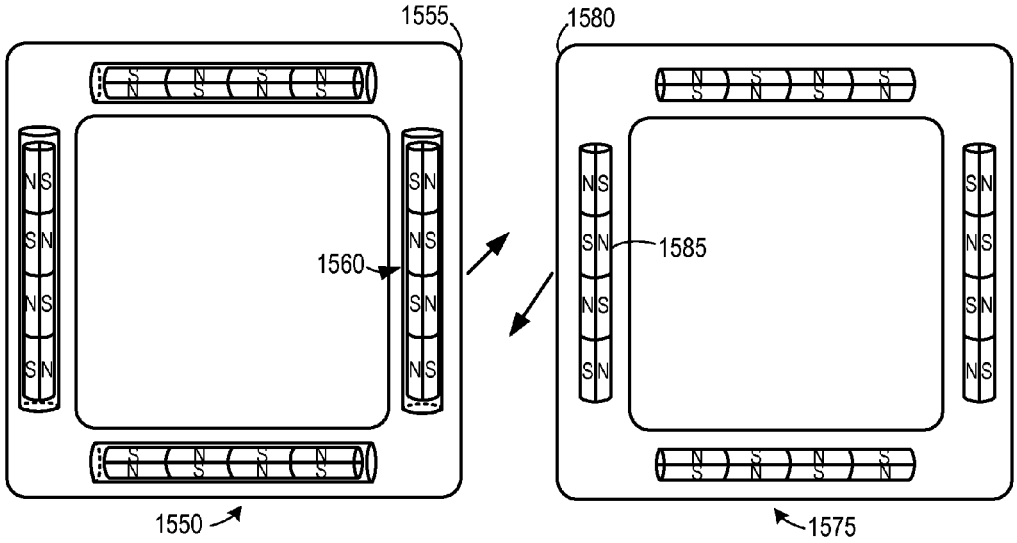
FIGS. 15A-15B illustrate first and second connector apparatus magnetically linking along askew outer perimeters.
Figure 15B:
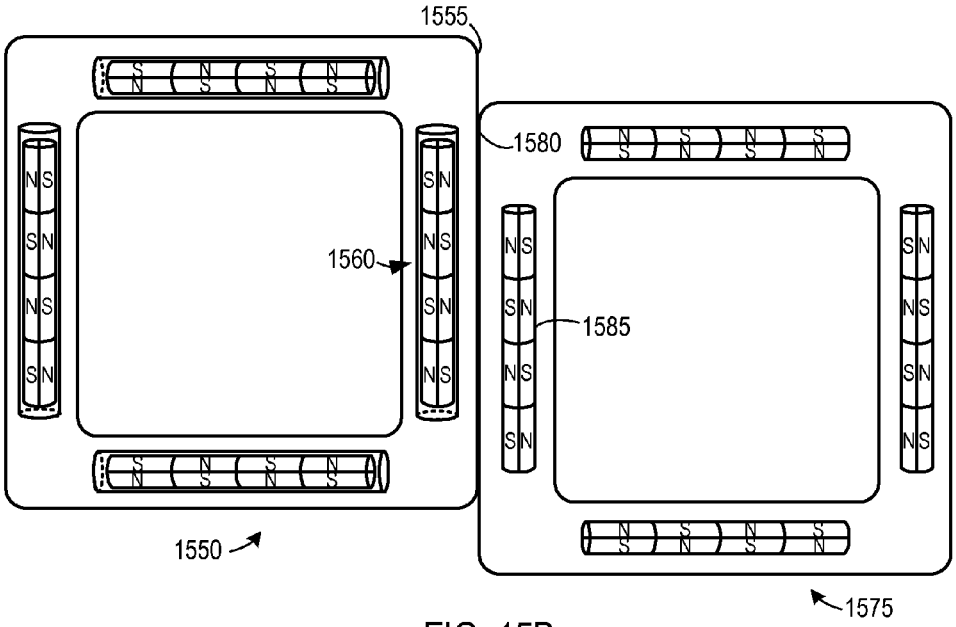

FIG. 15A illustrates first and second connector apparatus 1550 and 1575 approaching one another. As illustrated, the magnetic sections within magnetic assembly and enclosure combination 1560 are not aligned with respect to those of multi-pole magnetic assembly 1585. Accordingly, if first and second connector apparatus 1550 and 1575 were magnetically linked longitudinally aligned along outer perimeters 1555 and 1580, one of the multi-pole magnetic assemblies would need to rotate. However, as illustrated in FIG. 15B, first connector apparatus 1550 may magnetically link with second connector apparatus 1575 such that their respective outer perimeters 1555 and 1580 are longitudinally askew by a single magnetic section without any need for magnetic rotation.

It should also be understood that embodiments are contemplated in which only one of the two connector apparatus that are to be connected together includes a rotatable multi-pole magnetic assembly. As long as one of the multi-pole magnetic assemblies can rotate, it can be connected with another apparatus comprising a multi-pole assembly that is fixed and not rotatable.

Figure 16A:
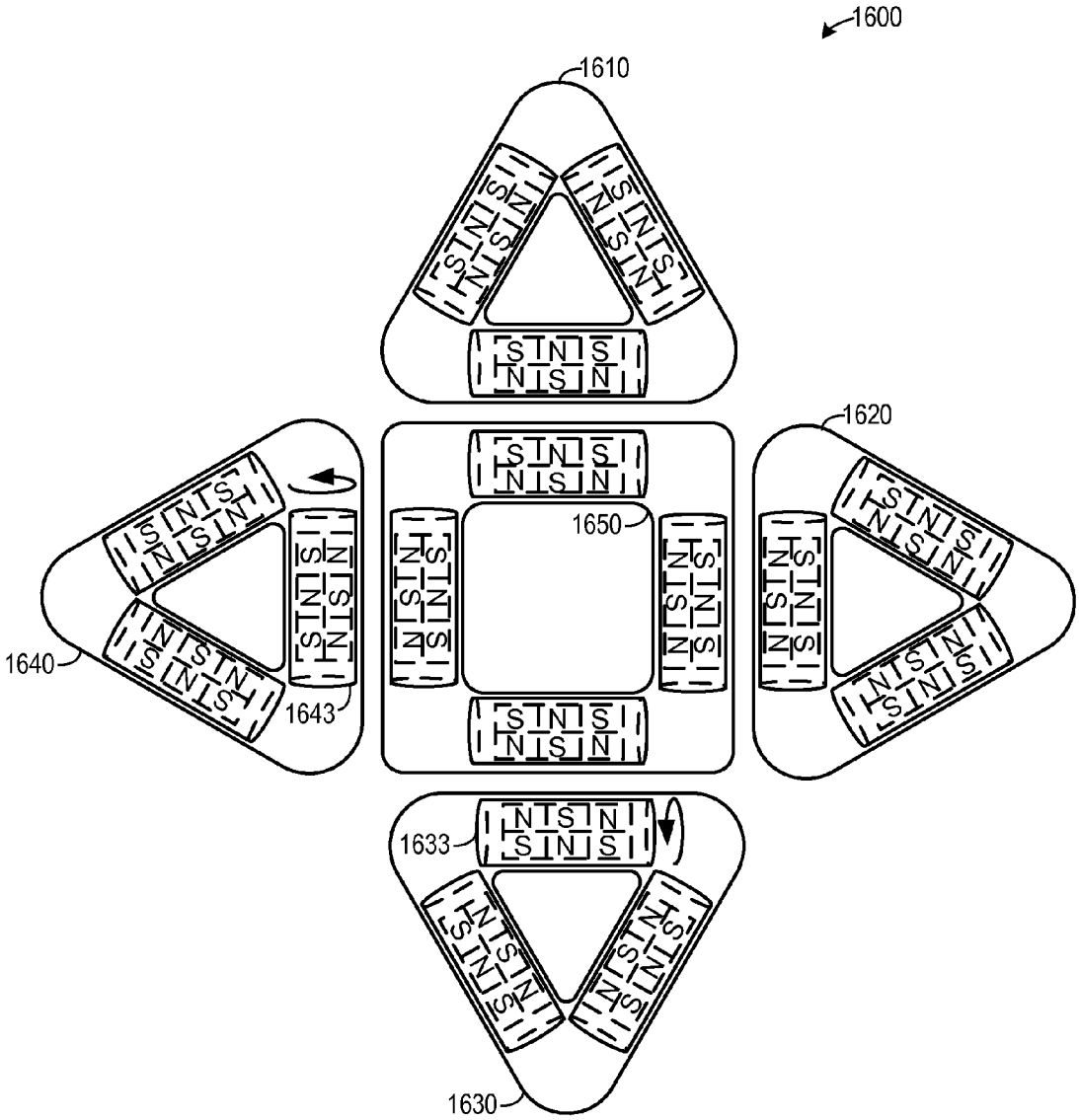
FIG. 16A illustrates a connector apparatus including a rectangular connection member in the process of being magnetically linked to four triangular connection members, including rotatable magnetic assembly and enclosure combinations adjacent each connection edge of each connection member.

FIG. 16A illustrates a connector apparatus 1600 comprising a rectangular connection member 1650 in the process of being magnetically linked to four triangular connection members 1610-1640. Rectangular connection member 1650 and each of triangular connection members 1610-1640 may include a magnetic assembly or magnetic assembly and enclosure combination adjacent each connection edge of each respective connection member 1610-1650. Each magnetic assembly or magnetic assembly and enclosure combination may be configured to rotate, so as to allow the polarities of each magnetic section of each multi-pole magnetic assembly to align with the magnetic sections of a multi-pole magnetic assembly in an adjacent connection member 1610-1650. Accordingly, each connection edge of rectangular connection member 1650 may be magnetically linked to a connection edge of one of the triangular connection members 1610-1640.

According to various embodiments, the magnetic assembly within each magnetic assembly and enclosure combination may be configured to rotate with or, alternatively, with respect to, its corresponding enclosure. Accordingly, since the magnetic assemblies are free to rotate, the connection edges of each of rectangular connection member 1650 and triangular connection members 1610-1640 may be magnetically linked at any angle, and may be pivoted with respect to one another once linked.

Figure 16B:
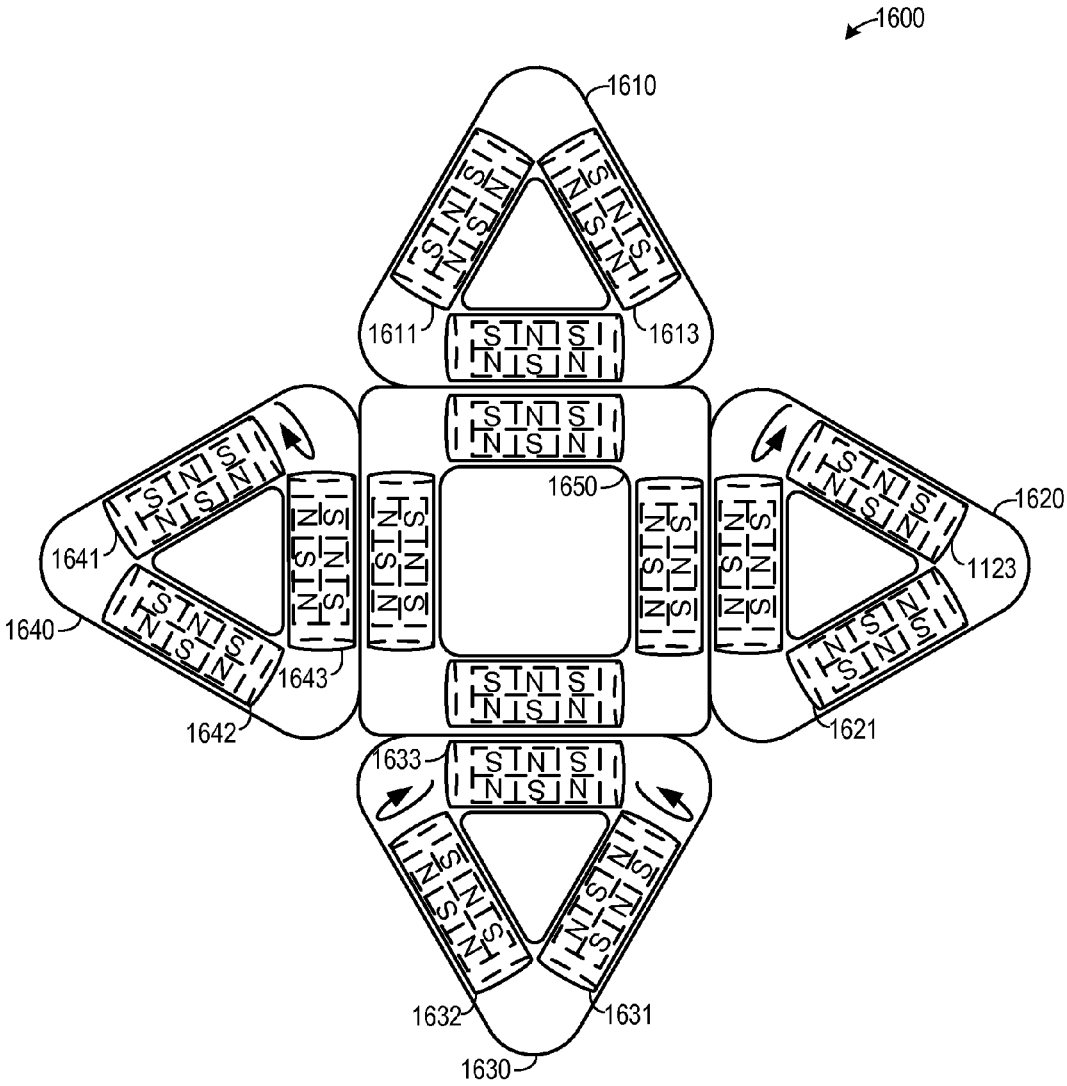
FIG. 16B illustrates the connector apparatus including a rectangular connection member magnetically linked to four triangular connection members, the magnetic assembly and enclosure combinations rotated such that opposite polarities are aligned.

As illustrated in the transition from FIG. 16A to FIG. 16B, multi-pole magnetic assemblies 1633 and 1643 may rotate about their longitudinal axes in order to align the polarities of their respective magnetic sections in order to magnetically link with their respective adjacent multi-pole magnetic assemblies within rectangular connection member 1650.

FIG. 16B illustrates a connector apparatus 1600 comprising rectangular connection member 1650 magnetically linked at each connection edge to a connection edge of each of triangular connection members 1610-1640. Multi-pole magnetic assemblies 1633 and 1643 have rotated about their longitudinal axes in order to align and magnetically link with corresponding multi-pole magnetic assemblies in rectangular connection member 1650.

According to various embodiments, each of triangular connection members 1610-1640 may be pivoted with respect to rectangular connection member 1650 about their respective magnetically linked sides. Accordingly, triangular connection members 1610-1640 may be brought together in order to form a pyramid having a rectangular base and four triangular faces. In such embodiments, each remaining unlinked connection member of each of triangular connection members 1610-1640 may be magnetically linked to a connection edge of another of triangular connection members 1610-1640. The multi-pole magnetic assemblies in each connection edge of each of triangular connection member 1610-1640 may rotate about its longitudinal axis, either with or with respect to an enclosure, in order to align the polarities of the respective magnetic sections.

Figure 17:
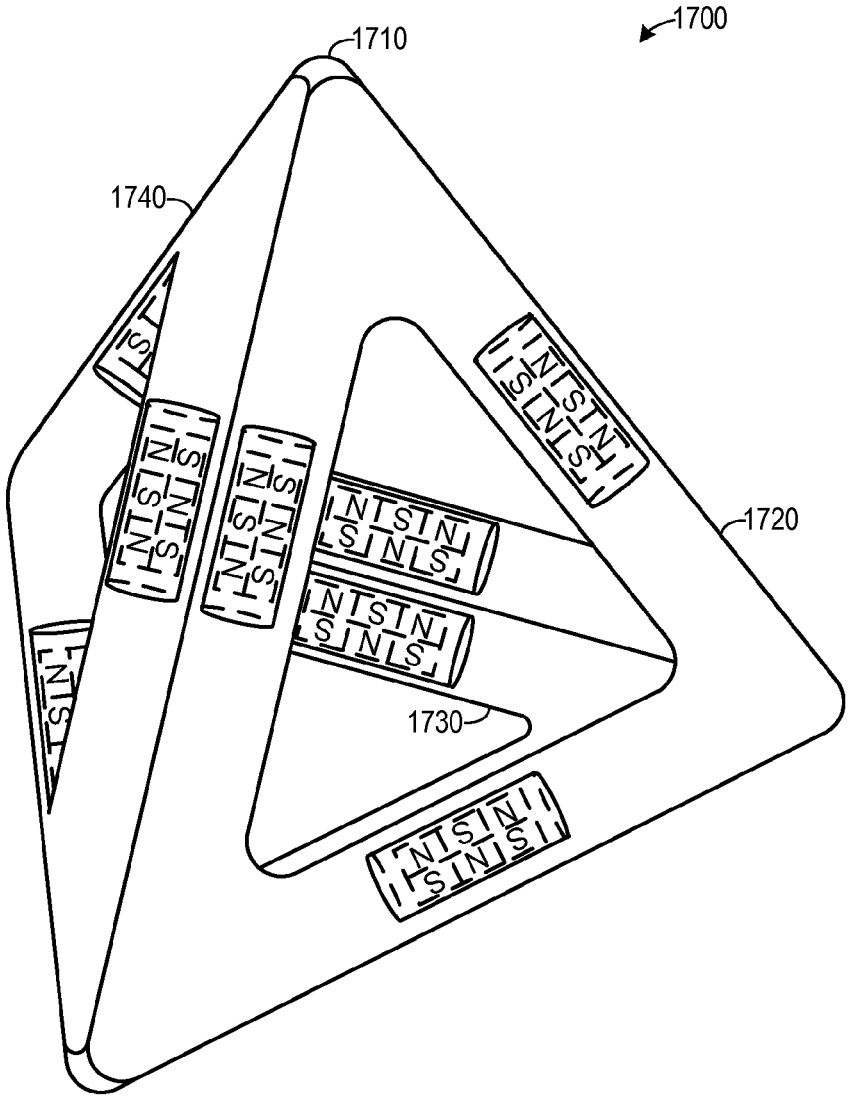
FIG. 17 illustrates a connector apparatus comprising four triangular connection members, including rotatably aligned magnetic assembly and enclosure combinations magnetically linking each connection edge of the four triangular connection members in order to form a tetrahedron.

FIG. 17 illustrates a connector apparatus 1700 comprising four triangular connection members 1710, 1720, 1730, and 1740. Each triangular connection members 1710, 1720, 1730, and 1740 may include one or more multi-pole magnetic assembly and enclosure combinations. Each multi-pole magnetic assembly and enclosure combination may rotatably allow each connection edge of each of triangular connection members 1710, 1720, 1730, and 1740 to magnetically link with another connection edge of another of triangular connection members 1710, 1720, 1730, and 1740, so as to form a tetrahedron. According to various embodiments, each connection edge of each triangular connection member 1710, 1720, 1730, and 1740 may comprise an enclosure and encase a multi-pole magnetic assembly configured to rotate about its longitudinal axis.

Alternatively, each connection edge of each triangular connection member 1710, 1720, 1730, and 1740 may secure, either rotatably or fixedly, an enclosure configured to encase one or more multi-pole magnetic assemblies. In embodiments in which the connection member fixedly secures an enclosure, the multi-pole magnetic assembly may be configured to rotate about its longitudinal axis within and with respect to the enclosure. In embodiments in which the connection member rotatably secures an enclosure, the multi-pole magnetic assembly may be configured to rotate about its longitudinal axis together with the enclosure as the enclosure rotates.

According to various embodiments, any polygonal shape may be used in place of triangular connection members 1710, 1720, 1730, and 1740 and magnetically link in order to form a polyhedron having any number of faces. Similarly, any combination of various polygonal shapes may be magnetically linked in order to form any number of shapes and/or compositions of shapes. For example, four rectangular connection members may be linked together with four triangular connection members in order to form an obelisk. Moreover, some embodiments may comprise members extending generally in only a single dimension, such that polygonal shapes may be made using several separate magnetic connector apparatus, each making up one side of the polygon.

As previously described, a multi-pole magnetic assembly may be formed using a single continuous magnetic material, or alternatively, a multi-pole magnetic assembly may be formed by joining multiple pairs of oppositely polarized magnetic sections linked end to end, such that each magnetic section is magnetically polarized opposite that of each adjacent magnetic section.

Figure 18A:
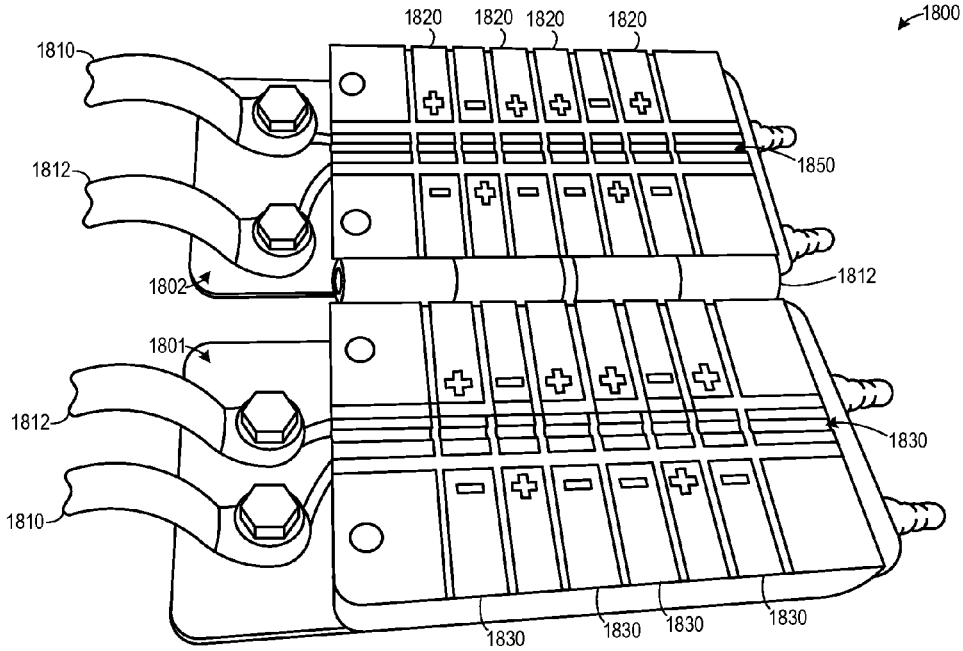
FIG. 18A illustrates a magnetizing apparatus configured with a bottom plate and a hinged top plate configured to create a multi-pole magnetic assembly.

FIG. 18A illustrates a magnetizing apparatus 1800 configured with a bottom plate 1801 and a top plate 1802 configured to create a multi-pole magnetic assembly. As illustrated, top plate 1802 may be pivoted about hinge 1812 until top plate 1802 is positioned directly above bottom plate 1801. In alternative embodiments, top plate 1802 may not be attached to bottom plate 1801 via hinge 1812 and may instead be pressed directly down against bottom plate 1801. As illustrated, each of bottom 1801 and top 1802 plates may include one or more grooves 1850 configured to receive a magnetizable material. Adjacent each groove are magnetizing plates 1820 and 1830 configured to radiate a magnetizable material placed within groove 1850 with magnetic fields of alternating polarity.

Figure 18B:
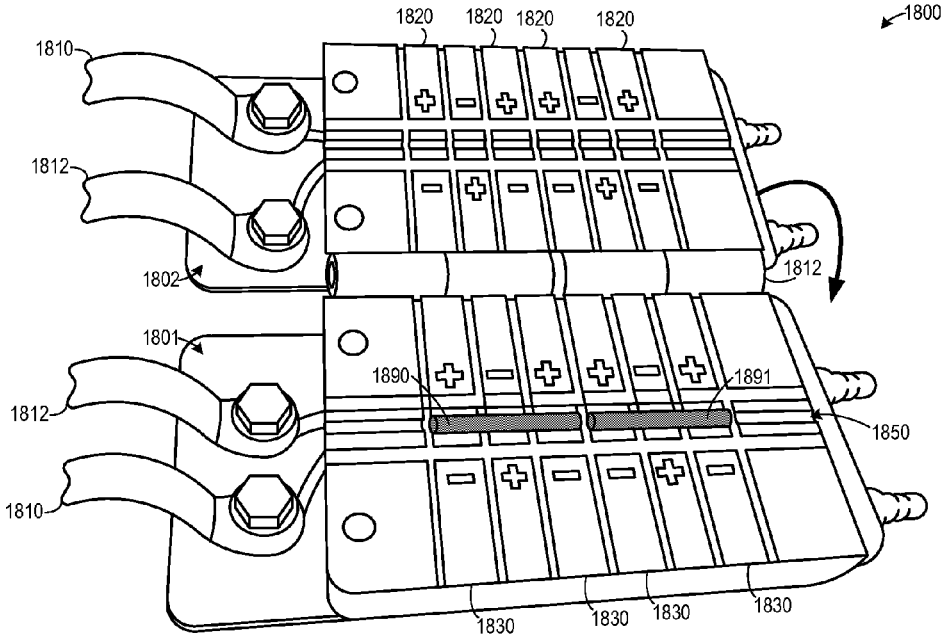
FIG. 18B illustrates the magnetizing apparatus with two magnetizable cylinders in place.

FIG. 18B illustrates the magnetizing apparatus 1800 with two magnetizable cylinders 1890 and 1891 in place. Once magnetizable cylinders 1890 and 1891 are in place, top plate 1802 may be pivoted about hinge 1812 onto bottom plate 1801. A current may be provided to cables 1810 and 1812 in order to create positive and negative magnetic fields along magnetizing plates 1820 and 1830, respectively. The magnetizing plates 1820 and 1830 having alternating magnetic polarization may magnetize magnetizable cylinders 1890 and 1891 so as to create a multi-pole magnetic assembly including a first half and second half extending along a longitudinal axis. The first half may include magnetic sections of alternating polarity and the second half may include a corresponding number of magnetic sections each having a polarity opposite that of an adjacent magnetic section in the first half.

Figure 18C:
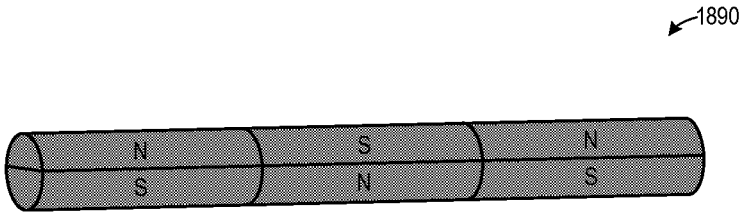
FIG. 18C illustrates a multi-pole magnetic assembly created using the magnetizing apparatus.

FIG. 18C illustrates an exemplary embodiment of a multi-pole magnetic assembly 1890 created using the magnetizing apparatus described in conjunction with FIGS. 18A and 18B. As illustrated, multi-pole magnetic assembly 1890 includes a first half and second half extending along a longitudinal axis. The first half includes three magnetic sections with alternating polarity and the second half includes three corresponding magnetic sections each polarized opposite that of the adjacent magnetic section in the first half.

Figure 19:
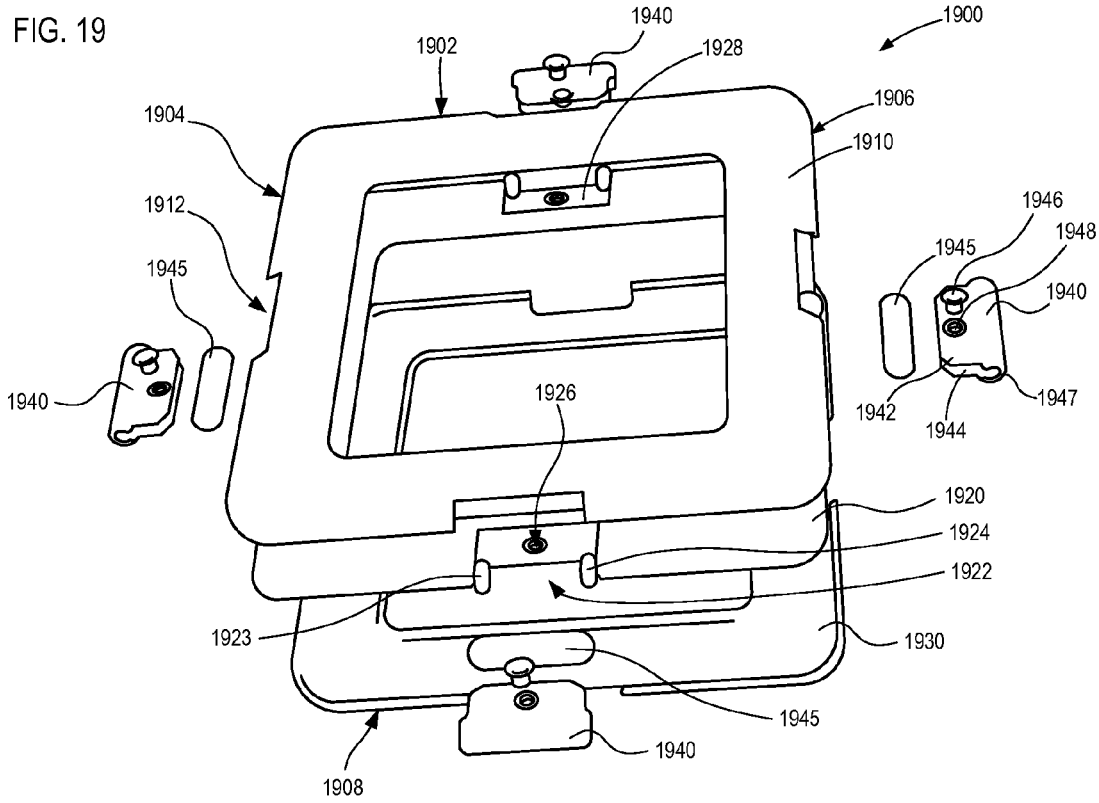
FIG. 19 illustrates an exploded view of an embodiment of a magnetic connector apparatus.

FIG. 19 illustrates an exploded view of an embodiment of a magnetic connector apparatus 1900. Magnetic connector apparatus 1900 comprises a first outer housing piece 1910, an inner retainer piece 1920, and a second outer housing piece 1930. Four magnet housings 1940 are coupled with the inner retainer piece 1920. Each of the magnet housings 1940 are configured to hold a respective magnet 1945. Magnets 1945 may be positioned within their respective magnet housings 1940 such that the magnet 1945 can rotate within the magnet housing 1940.

In some embodiments, one or more of the magnet housings 1940 may be configured to prevent or at least inhibit the magnets 1945 contained therein from being removed from the housing for safety purposes. Various features disclosed herein may facilitate this purpose. For example, one or more of the magnet housings 1940 may comprise a material that is of high strength and is difficult to break and/or deform. Examples of such materials include high-strength metals and other similar materials, such as a stainless steel metal, titanium, and/or related alloys, composite materials, such as carbon fiber, and other similar materials.

In some embodiments, other features may also, or alternatively, be provided to serve the purpose of inhibiting removal of the magnets. For example, as described in greater detail below, one or more magnet housing engaging members may be provided in order to at least substantially plug one or more openings in the magnet housings. Additionally, or alternatively, part of the magnetic connector apparatus, such as inner retainer piece 1920, may comprise one or more recessed regions that may be configured to receive one or more portions of the magnet housing to make it more difficult to remove the magnet housing from the magnetic connector apparatus.

The magnet housing may also include one or more openings for receiving a fastener for coupling the magnet housing to another portion of the magnetic connector apparatus, as also described in greater detail below. The magnet housing may also comprise one or more reinforced regions wherein the material is thicker at locations that might otherwise be vulnerable to wear, tampering, and the like. For example, in embodiments comprising openings that may be plugged by magnet housing engaging members, regions of the magnet housing adjacent to such openings may be reinforced, appropriately bent, shaped, or otherwise configured to further ensure that the magnet contained therein cannot be removed.

Figure 21:
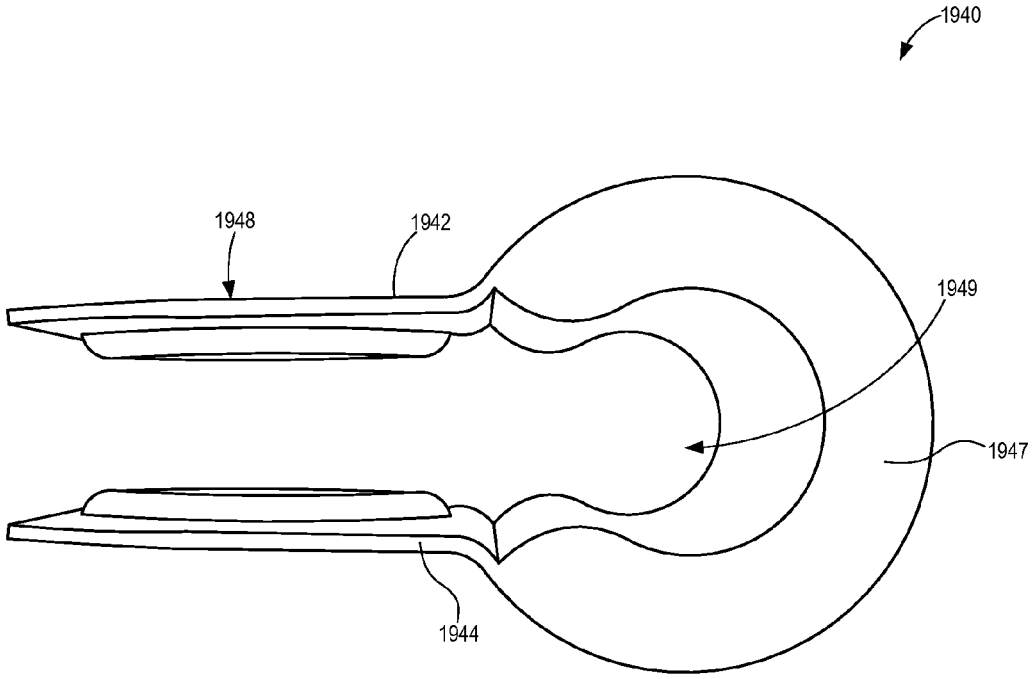
FIG. 21 illustrates a close-up view of an embodiment of a magnet housing of a magnetic connector apparatus.

Similarly, areas of the magnet housing adjacent to any opening for receiving a fastener may be reinforced, appropriately bent, shaped, or otherwise configured to further ensure that the magnet contained therein cannot be removed and/or that the magnet housing cannot be removed from the magnetic connector apparatus. For example, in the depicted embodiment, a cylindrical portion of the magnet housing that houses the magnet may be positioned relative to another portion of the magnet housing, such as a plate member, as a substantially perpendicular angle. This configuration is best seen in FIG. 21. In some preferred embodiments, the fasteners may comprise rivets or other such fasteners that cannot easily be removed by a user in order to further enhance the safety features of the apparatus.

In some embodiments, magnet 1945 may comprise one or more of the multi-pole magnetic assemblies discussed above. Such assemblies may comprise a first half and a second half extending substantially along a longitudinal axis. The first half may comprise at least two magnetic sections of alternating polarity and the second half may comprise a corresponding number of magnetic sections. Each magnetic section in the second half may have a polarity opposite that of an adjacent magnetic section in the first half such that the polarity of the magnet alternates along its length.

Each of the magnet housings 1940, and therefore each of the magnets 1940, is positioned along a connection edge of the apparatus 1900. More particularly, connection edges 1902, 1904, 1906, and 1908 of the square-shaped apparatus 1900 each has an accompanying magnet/magnet housing such that any of these connection edges may be used to magnetically couple the apparatus with another magnetic connector apparatus along one or more of the connection edges.

In the depicted embodiment, the first outer housing piece 1910 is positioned on an opposite side of the connector apparatus 1900 from the second outer housing piece 1930 such that the inner retainer piece 1920 is positioned in between the first outer housing piece 1910 and the second outer housing piece 1930. In some preferred implementations of methods for manufacturing magnetic connector apparatus, inner retainer piece 1920 may be sonically welded to first outer housing piece 1910 and second outer housing piece 1930, as described in greater detail below.

Figure 20:
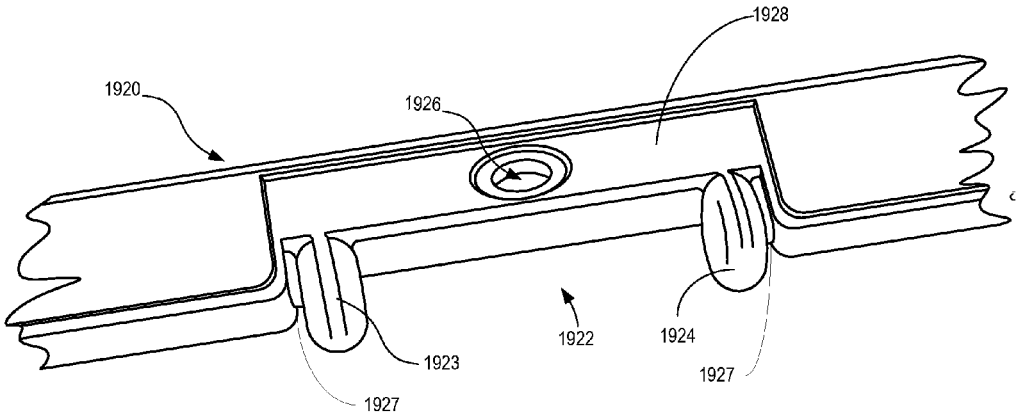
FIG. 20 illustrates a close-up view of a portion of an inner retainer piece of the embodiment of FIG. 19.

FIG. 20 illustrates a close-up view of a portion of inner retainer piece 1920 of magnetic connector apparatus 1900. More particularly, FIG. 20 illustrates a magnet housing receiver 1922 that is configured to engage a magnet housing 1940 (not shown in FIG. 20) to couple the magnet housing 1940 to the inner retainer piece 1920. Magnet housing receiver 1922 comprises a first magnet housing engaging member 1923 and a second magnet housing engaging member 1924. First magnet housing engaging member 1923 is configured to engage a first end of a magnet housing 1940 and second magnet housing engaging member 1924 is configured to engage a second end of the magnet housing 1940 opposite from the first end.

In the depicted embodiment, the first and second magnet housing engaging members, 1923 and 1924 respectively, each comprise a magnet housing plug that is configured to at least substantially seal an opening in a magnet housing 1940. In some embodiments, one or more of the magnet housing engaging members and/or at least a portion of one or more of the magnet housings may be made up of a flexible or resilient material that is configured to facilitate such a sealing function. For example, such material(s) may comprise one or more of a plastic, rubber, flexible graphite, elastomer, foam, cork, etc.

In the depicted embodiment, the first and second magnet housing engaging members, 1923 and 1924 respectively, are both formed with an at least substantially circular radius having a radius of curvature that matches a radius of curvature of a corresponding portion of a magnet housing 1940. The corresponding portion of the magnet housing is best seen in FIG. 21, as described below.

FIG. 21 illustrates a close-up view of an embodiment of a magnet housing 1940 that may be suitable for use in some embodiments of magnetic connector apparatus disclosed herein. As shown in this figure, magnet housing 1940 comprises a body member 1947 defining a cylindrical cavity. At opposite ends of the cylindrical cavity, body member 1947 defines openings 1949. One or both of openings 1949 may be configured to receive a magnet housing engaging member, such as magnet housing engaging members 1923 and 1924 illustrated in FIG. 20. The cavity defined by body member 1947 is configured to receive a magnet therein, such as magnet 1945.

In the depicted embodiment, the ends of magnet housing that define openings 1949 have a formed radius to add to the structural strength of the device and further prevent the magnet contained therein from being removed/accessed. Openings 1949 are at least substantially circular and are formed with a radius of curvature that at least substantially matches a radius of curvature of one or more corresponding magnet housing engaging members (in this embodiment magnet housing engaging members 1923 and 1924). By providing matching radii of curvature between these components, access to the magnet 1945 housed within magnet housing 1940 may be prevented in order to enhance the safety of the device, as described elsewhere herein.

The one or more magnet housing engaging members may be coupled with another component of the device, such as the inner retainer piece 1920, in a variety of different ways. For example, a coupling member 1927 may be provided to couple each of the magnet housing engaging members 1923 and 1924 to inner retainer piece 1920, as illustrated in FIG. 20. Coupling member(s) 1927 may, in some embodiments, be an integral part of, and thus comprised of the same material as, the magnet housing engaging members. In other embodiments, the one or more coupling members may be made up of a different material. For example, in some embodiments, the coupling members may be integral with the inner retainer piece 1920, and thus may comprise a metal, metal alloy, plastic, or other material that is used to make up inner retainer piece 1920. In any event, it is preferable that the link between the retainer piece 1920 (or another portion of the device) and the magnet housing be strong enough to withstand any foreseeable tampering such that the magnet(s) housed within the magnet housing(s) are not capable of being removed with any foreseeable forces resulting from use of the device.

Magnet housing 1940 also comprises a first plate member 1942 extending from body member 1947 and a second plate member 1944 extending from an opposite end of body member 1947. Both first plate member 1942 and second plate member 1944 comprise fastener openings 1948. Fastener openings 1948 may be configured to receive a fastener for coupling the magnet housing 1940 to a retainer piece, such as inner retainer piece 1920. The retainer piece may therefore include a similar fastener opening for receiving the fastener. For example, inner retainer piece 1920 includes a fastener opening 1926 that is configured to be aligned with fastener openings 1948 in first plate member 1942 and second plate member 1944 and receive a fastener 1946 therethrough, as illustrated in FIGS. 19-21. Various fasteners may be used, such as rivets, screws, bolts, and pins.

One or more regions on the magnet housing may also be reinforced, appropriately bent, shaped, or otherwise configured to further ensure that the magnet housing and/or the magnet contained therein cannot be removed. For example, in the magnet housing 1940 depicted in FIG. 21, the opposing ends of body member 1947 that are configured to receive the magnet housing engaging members have reinforced metal bent in a circular manner to enhance the strength, and therefore safety, of the magnet housing 1940. Similarly, magnet housing 2940 comprises reinforced regions adjacent to fastener opening 1948 in order to serve similar ends. These reinforced regions may be configured to fit within a recessed region surrounding fastener opening 1926 on inner retainer piece 1920.

The inner retainer piece may further comprise one or more recessed regions for receiving a plate member of a magnet housing. For example, inner retainer piece 1920 comprises recessed region 1928 that is configured to receive first plate member 1942. A similar recessed region may be provided on a surface of inner retainer piece 1920 that is opposite from the surface shown in FIG. 20 for receiving second plate member 1944.

Other regions of the device may also include recessed regions. For example, as shown in FIG. 20, the area surrounding fastener opening 1926 is stamped or otherwise recessed such that an appropriate fastener, such as a rivet, may be received therein and such that, once received in the fastener opening, the fastener is rendered at least substantially inaccessible to a user of the apparatus for safety purposes. As discussed above, it may be preferably in some embodiments, also for safety reasons, to provide a fastener that is not easily removable, such as a rivet or the like.

Although the area of the recessed regions 1928 in the depicted embodiment is substantially rectangular, it should be appreciated that other shapes are contemplated as well. However, preferably the shape of the recessed region at least substantially matches the shape of the corresponding plate member that is received therein.

Figure 22:
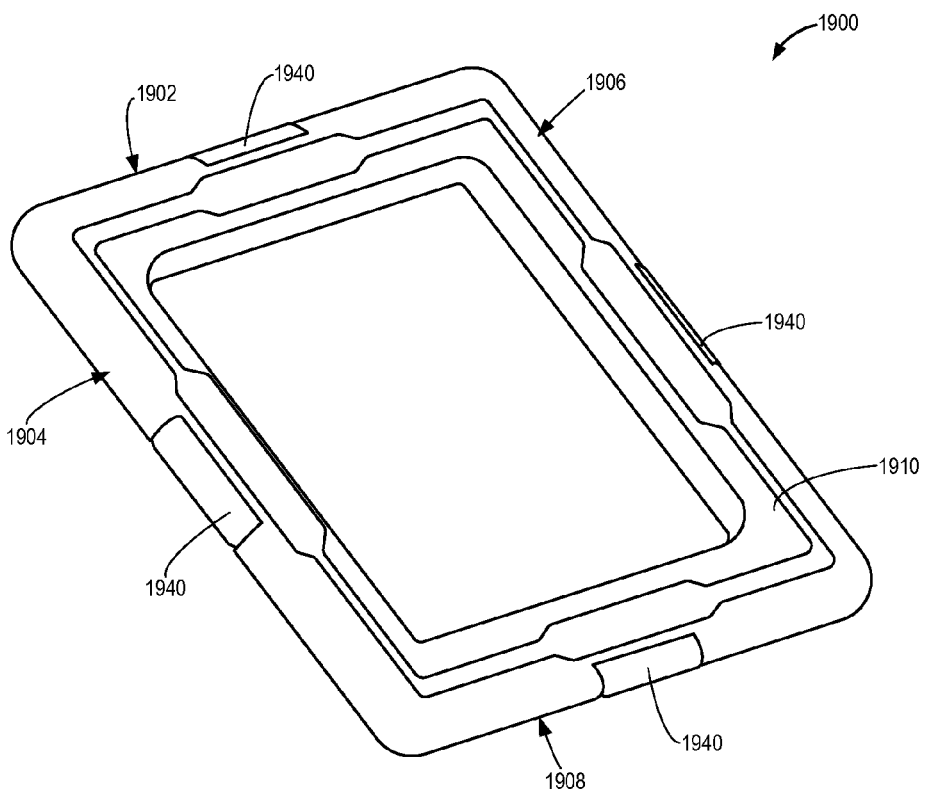
FIG. 22 illustrates a perspective view of the magnetic connector apparatus shown in FIG. 19.

FIG. 22 illustrates a perspective view of magnetic connector apparatus 1900. As shown in this figure, magnetic connector apparatus 1900 includes four connection edges 1902, 1904, 1906, and 1908. Each of these connection edges includes a magnet housing 1940 within which is contained a respective magnet (not visible in FIG. 22). One or more of the connection edges can be coupled with a connection edge of another connector apparatus, as described above, in order to build an assembly comprising multiple connector apparatus.

Figure 23A:
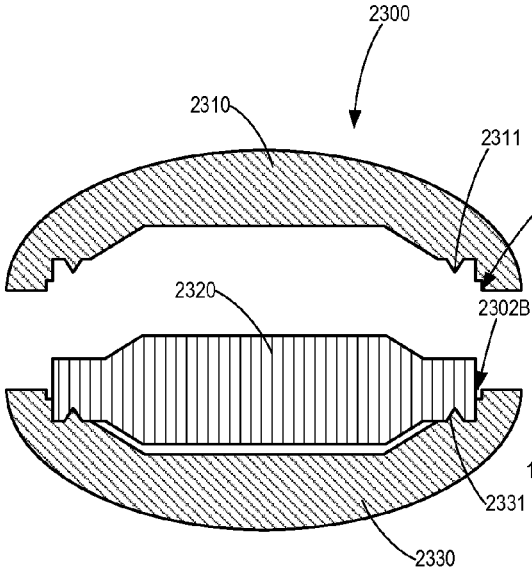
FIG. 23A illustrates a cross-sectional view of various components prior to undergoing a welding process in one implementation of a method for manufacturing a magnetic connector apparatus.
Figure 23B:
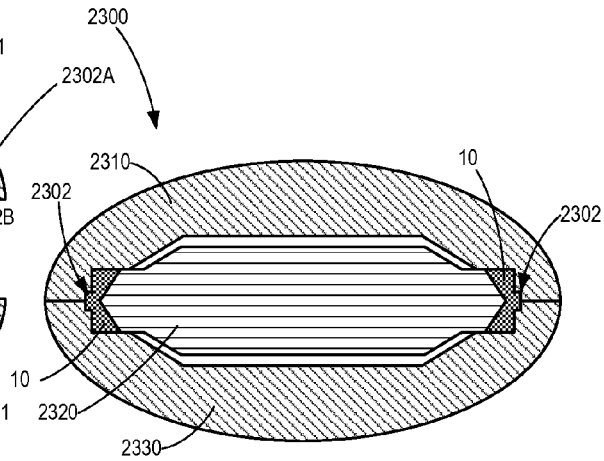
FIG. 23B illustrates a cross-sectional view of the components shown in FIG. 23A after undergoing a welding process.

FIGS. 23A and 23B illustrate cross-sectional views of the components used to manufacture another embodiment of a magnetic connector apparatus. FIG. 23A illustrates these components at a stage prior to undergoing a welding process in one implementation of a method for manufacturing a magnetic connector apparatus. FIG. 23B illustrates a cross-sectional view of the components shown in FIG. 23A after undergoing a welding process, which, in some implementations, may comprise a sonic welding process.

The components illustrated in FIGS. 23A and 23B that may be used to manufacture a magnetic connector apparatus 2300 include a first outer housing piece 2310, an inner retainer piece 2320, and a second outer housing piece 2330. One or more magnet housings may also be coupled with one or more of the first outer housing piece 2310, the inner retainer piece 2320, and the second outer housing piece 2330, as described above. However, a magnet housing is not depicted in these figures.

First outer housing piece 2310 comprises a joint weld protrusion 2311. As described above, joint weld protrusion 2311 comprises a V-shaped ridge. However, as described elsewhere herein, other shapes/configurations are also contemplated. Joint weld protrusion 2311 may extend around the entire perimeter of first outer housing piece 2310. However, other embodiments are also contemplated in which one or more joint weld protrusions only extend partially around such a perimeter.

A similar joint weld protrusion 2331 may be provided on second outer housing piece 2330, as shown in the figure. As with joint weld protrusion 2311, joint weld protrusion 2331 may extend around the entire perimeter of second outer housing piece 2330 or, alternatively, joint weld protrusion 2331 may extend partially around the perimeter. Joint weld protrusion 2331, like joint weld protrusion 2311, comprises a V-shaped ridge. However, in some embodiments joint weld protrusion 2331 may comprise a different shape than joint weld protrusion 2311.

Both first outer housing piece 2310 and second outer housing piece 2330 also comprise melt chambers, 2302A and 2302B, respectively. Both melt chamber 2302A and melt chamber 2302B are shaped with two sides that form a corner cutout shape. When the first outer housing piece 2310 is approximated with the second outer housing piece 2330, as shown in FIG. 23B, a joint melt chamber 2302 is formed. As illustrated in this figure, half of a first side of joint melt chamber 2302 is formed with one side of melt chamber 2302A and the other half of the first side of joint melt chamber 2302 is formed with one side of melt chamber 2302B. A second side of joint melt chamber 2302 is formed with a separate side of joint melt chamber 2302A and a third side of joint melt chamber 2302 opposite from the second side is formed with another side of joint melt chamber 2302B. The fourth and final side of joint melt chamber 2302 is formed from a portion of inner retainer piece 2320.

As also shown in FIG. 23B, a welding process may cause material from the joint weld protrusions and/or other portions of the components used to manufacture the apparatus to melt into joint melt chamber 2302. Melted material is shown in FIG. 23B at 10. Melted material 10 may also surround a portion of inner retainer piece 2320, as also shown in FIG. 23B.

Figure 24A:
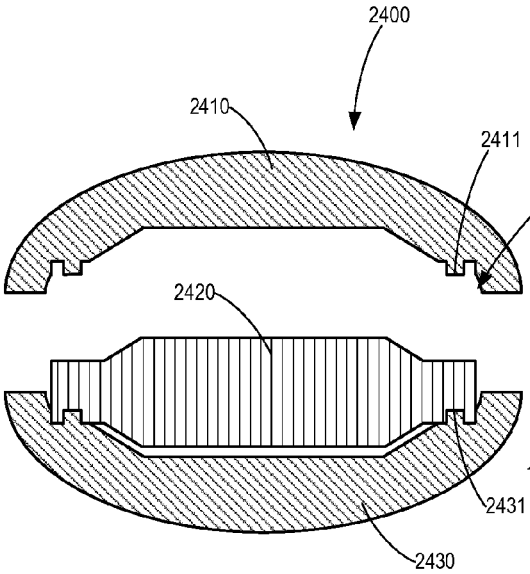
FIG. 24A illustrates a cross-sectional view of various components prior to undergoing a welding process in another implementation of a method for manufacturing another embodiment of a magnetic connector apparatus.
Figure 24B:
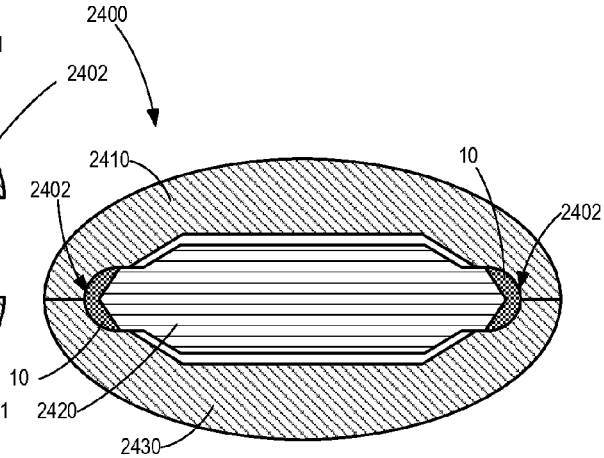
FIG. 24B illustrates a cross-sectional view of the components shown in FIG. 24A after undergoing a welding process.

FIG. 24A illustrates a cross-sectional view of various components prior to undergoing a welding process in another implementation of a method for manufacturing another embodiment of a magnetic connector apparatus. FIG. 24A illustrates these components at a stage prior to undergoing a welding process in one implementation of a method for manufacturing a magnetic connector apparatus. FIG. 24B illustrates a cross-sectional view of the components shown in FIG. 24A after undergoing a welding process, which, in some implementations, may comprise a sonic welding process.

The components illustrated in FIGS. 24A and 24B that may be used to manufacture a magnetic connector apparatus 2400 include, like magnetic connector apparatus 2300, a first outer housing piece 2410, an inner retainer piece 2420, and a second outer housing piece 2430. One or more magnet housings (not shown in FIGS. 24A and 24B) may also be coupled with one or more of the first outer housing piece 2410, the inner retainer piece 2420, and the second outer housing piece 2430, as described above.

First outer housing piece 2410 comprises a joint weld protrusion 2411. However, unlike joint weld protrusion 2311, joint weld protrusion 2411 comprises a relatively flat top and relatively parallel sides, rather than the relatively pointed tip and slanted sides of a V-shaped ridge. Joint weld protrusion 2411 may extend around the entire perimeter of first outer housing piece 2410.

A similar joint weld protrusion 2431 may be provided on second outer housing piece 2430, as shown in the figures. As with joint weld protrusion 2411, joint weld protrusion 2431 may extend around the entire perimeter of second outer housing piece 2430 or, alternatively, joint weld protrusion 2431 may extend partially around the perimeter. Joint weld protrusion 2431, like joint weld protrusion 2411, comprises a relatively flat top and parallel sides. However, in some embodiments joint weld protrusion 2431 may comprise a different shape than joint weld protrusion 2411. In other embodiments, a joint weld protrusion may only be provided on one of first outer housing piece 2410 and second outer housing piece 2430.

First outer housing piece 2410 also comprises a melt chamber 2402. Melt chamber 2402, unlike melt chambers 2302A and 2302B, comprises a rounded cutout or a substantially curvate cutout region. However, unlike melt chamber 2302, melt chamber 2402 only formed within first outer housing piece 2410. Second outer housing piece 2430 may also include a melt chamber, but does not in the embodiment depicted in FIGS. 24A and 24B.

Thus, when first outer housing piece 2410 is approximated with second outer housing piece 2430, as shown in FIG. 24B, a joint melt chamber is formed that is defined in part by curvate cutout region 2402 and in part by a portion of inner retainer piece 2420.

As also shown in FIG. 24B, a welding process may cause material from the joint weld protrusions and/or other portions of the components used to manufacture the apparatus to melt into the melt chamber. Melted material is shown in FIG. 24B at 10. Melted material 10 may also surround a portion of inner retainer piece 2420, as also shown in FIG. 24B.

Those having skill in the art will appreciate that many changes may be made to the details of the above-described embodiments without departing from the underlying principles of the invention. While the principles of this disclosure have been shown in various embodiments, many modifications of structure, arrangements, proportions, elements, materials, shapes, thicknesses, widths, heights, and components, may be used without departing from the principles and scope of this disclosure. These and other changes or modifications are intended to be included within the scope of the present disclosure.

The invention claimed is:

1. A magnetic connector apparatus, comprising:

a magnet housing;

a magnet positioned within the magnet housing such that the magnet can rotate within the magnet housing, wherein the magnet is configured to be magnetically connected with a second magnet positioned within a second magnet housing of second magnetic connector apparatus without the magnet and the second magnet directly contacting one another;

an inner retainer piece coupled with the magnet housing, wherein the inner retainer piece comprises a magnet housing receiver configured to engage the magnet housing to couple the magnet housing to the inner retainer piece;

a first outer housing piece coupled with the inner retainer piece; and a second outer housing piece coupled with the inner retainer piece, wherein the first outer housing piece is positioned on an opposite side of the connector apparatus from the second outer housing piece such that the inner retainer piece is positioned in between the first outer housing piece and the second outer housing piece, and wherein the magnet housing is positioned to extend along at least a portion of an edge of the inner retainer piece, along at least a portion of a connection edge of the first outer housing piece, and along at least a portion of a connection edge of the second outer housing piece such that the magnetic connector apparatus is configured to be magnetically connected with the second magnetic connector apparatus along a connection edge of the magnetic connector apparatus defined at least in part by the first outer housing piece and the second outer housing piece.

2. The magnetic connector apparatus of claim 1, wherein the magnet housing receiver comprises:

a first magnet housing engaging member; and a second magnet housing engaging member, wherein the first magnet housing engaging member is configured to engage a first end of the magnet housing, and wherein the second magnet housing engaging member is configured to engage a second end of the magnet housing opposite from the first end.

3. The magnetic connector apparatus of claim 2, wherein the first magnet housing engaging member comprises a first magnet housing plug configured to at least substantially seal an opening in the magnet housing at the first end, and wherein the second magnet housing engaging member comprises a second magnet housing plug configured to at least substantially seal an opening in the magnet housing at the second end.

4. The magnetic connector apparatus of claim 3, wherein both openings in the magnet housing are formed with an at least substantially circular radius, wherein the first magnet housing plug and the second magnet housing plug both have a radius of curvature that at least substantially matches the radii of curvature of the openings in the magnet housing.

5. The magnetic connector apparatus of claim 1, wherein the magnet housing comprises:

a body member comprising a cylindrical cavity, wherein the magnet is positioned within the cylindrical cavity; and a first plate member extending from the body member and coupled to a first surface of the inner retainer piece.

6. The magnetic connector apparatus of claim 5, further comprising a fastener for coupling the first plate member to the inner retainer piece, wherein the first plate member comprises a fastener opening for receiving the fastener.

7. The magnetic connector apparatus of claim 6, wherein the fastener comprises a rivet.

8. The magnetic connector apparatus of claim 5, wherein the magnet housing further comprises a second plate member extending from the body member and coupled to a second surface of the inner retainer piece opposite from the first surface.

9. The magnetic connector apparatus of claim 8, wherein the inner retainer piece comprises:

a first recessed region on the first surface for receiving the first plate member; and a second recessed region on the second surface for receiving the second plate member.

10. The magnetic connector apparatus of claim 1, further comprising an enclosure encasing the magnet, wherein the enclosure is positioned within the magnet housing, and wherein the apparatus is configured such that the enclosure is rotatable with respect to the magnet housing.

11. The magnetic connector apparatus of claim 1, further comprising an enclosure encasing the magnet, wherein the enclosure is positioned within the magnet housing, and wherein the apparatus is configured such that the enclosure is fixed with respect to the magnet housing and such that the magnet is rotatable with respect to the enclosure.

12. The magnetic connector apparatus of claim 1, wherein the magnet housing is positioned along a connection edge of the magnetic connector apparatus, and wherein the connection edge is configured to be magnetically connected with a connection edge of another magnetic connector apparatus.

13. The magnetic connector apparatus of claim 1, wherein the magnet housing comprises at least two redundant safety features for preventing the magnet from being removed from the magnet housing.

14. The magnetic connector apparatus of claim 13, wherein the at least two redundant safety features comprise one or more of a stainless steel material, a sonic weld, a magnet housing engaging member configured to at least substantially plug one or more openings in the magnet housing, a reinforced region wherein material of the magnet housing is thicker, a rivet for coupling the magnet housing to the inner retainer piece, and a recessed region for receiving a portion of the magnet housing.

15. A magnetic connector apparatus, comprising:

a first magnet housing;

a first magnet positioned within the first magnet housing such that the first magnet can rotate within the first magnet housing, wherein the first magnet comprises a multi-pole magnetic assembly comprising a first half and a second half extending substantially along a longitudinal axis of the multi-pole magnetic assembly, the first half comprising at least two magnetic sections of alternating polarity and the second half comprising a corresponding number of magnetic sections, each magnetic section in the second half having a polarity opposite that of an adjacent magnetic section in the first half;

an inner retainer piece coupled with the first magnet housing such that the first magnet housing is positioned along a first connection edge of the magnetic connector apparatus;

a second magnet housing, wherein the first and second magnet housings comprise:

a body member comprising a cylindrical cavity, wherein a magnet is positioned within the cylindrical cavity;

a first plate member extending from the body member and coupled to a first surface of the inner retainer piece;

a second plate member extending from the body member and coupled to a second surface of the inner retainer piece opposite from the first surface; and a fastener extending through an opening in at least one of the first and second plate members and through an opening in the inner retainer piece;

a second magnet positioned within the second magnet housing such that the second magnet can rotate with the second magnet housing, wherein the second magnet housing is coupled with the inner retainer piece such that the second magnet housing is positioned along a second connection edge of the magnetic connector apparatus, and wherein the second magnet comprises a second multi-pole magnetic assembly comprising a first half and a second half extending substantially along a longitudinal axis of the second multi-pole magnetic assembly, the first half comprising at least two magnetic sections of alternating polarity and the second half comprising a corresponding number of magnetic sections, each magnetic section in the second half having a polarity opposite that of an adjacent magnetic section in the first half;

a first outer housing piece coupled with the inner retainer piece; and a second outer housing piece coupled with the inner retainer piece, wherein the first outer housing piece is positioned on an opposite side of the connector apparatus from the second outer housing piece such that the inner retainer piece is positioned in between the first outer housing piece and the second outer housing piece.

16. A method for manufacturing a magnetic connector apparatus, the method comprising the steps of:

providing a first outer housing piece;

providing a second outer housing piece;

providing an inner retainer piece, wherein at least one of the first outer housing piece and the second outer housing piece comprises at least one weld joint protrusion, and wherein a melt chamber is positioned adjacent to the at least one weld joint protrusion;

providing a magnet housing;

positioning a magnet within the magnet housing such that the magnet is rotatable within the magnet housing;

coupling the magnet housing to at least one of the first outer housing piece, the second outer housing piece, and the inner retainer piece; and sonic welding the first outer housing piece to the second outer housing piece with the inner retainer piece positioned in between the first outer housing piece and the second outer housing piece, wherein the weld joint protrusion is positioned and configured such that material from the weld joint protrusion melts into the melt chamber during the sonic welding process such that melted material within the melt chamber bonds the first outer housing piece and the second outer housing piece to the inner retainer piece as the melted material solidifies.

17. The method of claim 16, wherein both the first outer housing piece and the second outer housing piece comprise weld joint protrusions.

18. The method of claim 17, wherein both the first outer housing piece and the second outer housing piece comprise melt chambers.

19. The method of claim 18, wherein the first outer housing piece is welded to the second outer housing piece such that the first outer housing piece melt chamber is at least substantially aligned with the second outer housing piece melt chamber during the welding.

20. The method of claim 16, wherein the weld joint protrusion comprises a V-shaped ridge formed adjacent to at least a portion of a perimeter of at least one of the first outer housing piece and the second outer housing piece.

21. The method of claim 16, wherein the first outer housing piece comprises a plastic material, wherein the second outer housing piece comprises a plastic material, wherein the inner retainer piece comprises a plastic material, and wherein the step of sonic welding comprises sonic welding the inner retainer piece to both the first outer housing piece and the second outer housing piece.

22. The method of claim 21, wherein the step of sonic welding comprises melting material from the first outer housing piece weld joint protrusion and material from the second outer housing piece weld joint protrusion into a joint melt chamber formed at least in part by the first outer housing piece melt chamber and the second outer housing piece melt chamber.

23. A magnetic connector apparatus, comprising:

a magnet housing;

a magnet positioned within the magnet housing such that the magnet can rotate within the magnet housing;

an inner retainer piece coupled with the magnet housing, wherein the inner retainer piece comprises a magnet housing receiver configured to engage the magnet housing to couple the magnet housing to the inner retainer piece;

a first outer housing piece coupled with the inner retainer piece; and a second outer housing piece coupled with the inner retainer piece, wherein the first outer housing piece is positioned on an opposite side of the connector apparatus from the second outer housing piece such that the inner retainer piece is positioned in between the first outer housing piece and the second outer housing piece, and wherein the magnet housing comprises:

a body member comprising a cylindrical cavity, wherein the magnet is positioned within the cylindrical cavity; and a first plate member extending from the body member and fixedly coupled to a first surface of the inner retainer piece.

24. The magnetic connector apparatus of claim 23, wherein the magnet housing receiver comprises:

a first magnet housing engaging member; and a second magnet housing member, wherein the first magnet housing engaging member is configured to engage a first end of the magnet housing, and wherein the second magnet housing engaging member is configured to engage a second end of the magnet housing opposite from the first end.

25. The magnetic connector apparatus of claim 24, wherein the first magnet housing engaging member comprises a first magnet housing plug configured to at least substantially seal an opening in the magnet housing at the first end, and wherein the second magnet housing engaging member comprises a second magnet housing plug configured to at least substantially seal an opening in the magnet housing at the second end.

26. The magnetic connector apparatus of claim 25, wherein both openings in the magnet housing are formed with an at least substantially circular radius, wherein the first magnet housing plug and the second magnet housing plug both have a radius of curvature that at least substantially matches the radii of curvature of the openings in the magnet housing.

27. The magnetic connector apparatus of claim 23, wherein the magnet housing comprises at least two redundant safety features for preventing the magnet from being removed from the magnet housing.

28. The magnetic connector apparatus of claim 27, wherein the at least two redundant safety features comprise one or more of a stainless steel material, a sonic weld, a magnet housing engaging member configured to at least substantially plug one or more openings in the magnet housing, a reinforced region wherein material of the magnet housing is thicker, a rivet for coupling the magnet housing to the inner retainer piece, and a recessed region for receiving a portion of the magnet housing.

29. The magnetic connector apparatus of claim 23, wherein the magnet housing further comprises a second plate member extending from the body member and coupled to a second surface of the inner retainer piece opposite from the first surface.

* * * * *